US008471183B2

(12) United States Patent
Tabuchi

(10) Patent No.: US 8,471,183 B2
(45) Date of Patent: Jun. 25, 2013

(54) INDUCTION HEATING APPARATUS

(75) Inventor: Hidetaka Tabuchi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 372 days.

(21) Appl. No.: 12/786,905

(22) Filed: May 25, 2010

(65) Prior Publication Data

US 2010/0320196 A1 Dec. 23, 2010

(30) Foreign Application Priority Data

Jun. 18, 2009 (JP) ..... 2009-145446

(51) Int. Cl.
*H05B 6/04* (2006.01)

(52) U.S. Cl.
USPC ..... 219/660

(58) Field of Classification Search
USPC ..... 219/660
See application file for complete search history.

(56) References Cited

U.S. PATENT DOCUMENTS

2008/0074381 A1* 3/2008 Kumamoto ..... 345/102

FOREIGN PATENT DOCUMENTS

JP 2007-286495 A 11/2007

OTHER PUBLICATIONS

Machine translation of JP-2007-286495 (Nov. 2007).*

* cited by examiner

*Primary Examiner* — Lex Malsawma
(74) *Attorney, Agent, or Firm* — Canon USA, Inc., IP Division

(57) ABSTRACT

An induction heating apparatus includes a current supply unit configured to supply a high-frequency current to a coil for inductively heating a conductive heating element based on a direct current obtained by rectifying AC power supplied from an AC power supply, a driving unit configured to output a drive pulse for supplying the high-frequency current from the current supply unit, a control unit configured to control a frequency of a drive pulse output by the driving unit, and a power limiting unit configured to limit an operation of the driving unit when input power determined based on an input voltage of the AC power supply and an input current to the current supply unit exceeds a predetermined value.

3 Claims, 22 Drawing Sheets

INDUCTION HEATING APPARATUS

BACKGROUND OF THE INVENTION

1. Field of the Invention

The present invention relates to an induction heating apparatus, and more particularly, to a safety apparatus therefor.

2. Description of the Related Art

An electrophotographic image forming apparatus generally includes a fixing device for fixing a toner image transferred onto a recording material such as paper by applying heat and pressure. Although a heating system using a ceramic heater or a halogen heater has been commonly used as a configuration of the fixing device, an electromagnetic induction heating system, which quickly generates heat, has been used in recent years.

FIG. 21 illustrates a configuration of a power supply device 100 for supplying power to a fixing device 7 using an induction heating system. The power supply device 100 illustrated in FIG. 21 is supplied with alternating-current (AC) power from a commercial power supply 500 when a power supply switch 501 is turned on. The power supply device 100 includes a diode bridge 101, a filter capacitor 102, resonance capacitors 105 and 106 forming a resonance circuit, and a coil L. The power supply device 100 further includes first and second switch elements 103 and 104, a driving unit 112 for driving the two switch elements 103 and 104 by driving signals 121 and 122, a voltage detection unit 115 for detecting an input voltage, and a current detection unit 116 for detecting an input current. The voltage detection unit 115 and the current detection unit 116 respectively detect an input voltage Vin and an input current Iin that are supplied from the commercial power supply 500, and output their detection values Vs and Is to a central processing unit (CPU) 400 serving as a control unit. Relationships of $Vs=\alpha Vin$ ($\alpha$ is a coefficient) and $Is=\beta Iin$ ($\beta$ is a coefficient) hold.

The CPU 400 calculates input power from the input voltage detection value Vs and the input current detection value Is from the power supply device 100. The CPU 400 determines the driving frequencies of drive pulse signals 131 and 132, which are sent out to the driving unit 112 within the power supply device 100, based on the result of the calculation and a temperature detection value T from a temperature detection unit 114 for detecting the temperature of a conductive heating element FB. The power supplied to the fixing device 7 changes according to the driving frequencies, and the temperature of the conductive heating element FB also changes.

The driving unit 112 amplifies the drive pulse signals 131 and 132, and outputs the driving signals 121 and 122. The switch elements 103 and 104 are alternately turned on/off, respectively, according to the driving signals 121 and 122, to supply a high-frequency current to the coil L. When the high-frequency current is caused to flow through the coil L, an eddy current is induced on a surface of the conductive heating element FB by a generated AC magnetic field so that Joule heat is generated. Therefore, the conductive heating element FB generates heat.

In the induction heating system, the CPU 400 performs power control and temperature control. When the CPU 400 runs away, or an abnormality or the like occurs in the temperature detection unit 114, however, the switch elements 101 and 102 are not appropriately controlled. More power than necessary may be supplied to the fixing device 7. As a result, the temperature of the fixing device 7 excessively rises.

In order to prevent the temperature of the fixing device 7 from thus excessively rising, an input limiting unit (not illustrated) for limiting an input current is provided independently of control by a CPU, as discussed in Japanese Patent Application Laid-Open No. 2007-286495. The input limiting unit temporarily or completely stops the operation of a driving unit when the input current continuously exceeds an input current limit value for a predetermined period of time or more. The input current limit value varies according to a voltage detected by a voltage detection unit. More specifically, when the input current rises to the limit value, the input limiting unit stops outputting a drive pulse so that input power is limited.

Commercial power supplies are classified into a 100-V commercial power supply and a 200-V commercial power supply according to areas. In Japanese Patent Application Laid-Open No. 2007-286495, the input current limit value is expressed by a primary expression of an input voltage detection value. Therefore, an input power limit value is expressed by a secondary function of the input voltage detection value. FIG. 4A illustrates the circuit configuration of an input current limit value calculation circuit, and FIG. 5A is a graph of an input current limit value.

In FIG. 5A, an input current limit value I2 is expressed by the following equation:

$$I2=-(R2/R1)\times Vs+(1+R2/R1)\times V2$$

Accordingly, an input current limit value Ilim is expressed by the following equation:

$$Ilim=\{-R2/R1)\times Vs+\{(1+R2/R1)\times V2\}\}/\beta$$

Here, $\beta$ is a transform coefficient for detecting the input current Iin as the input current detection value Is by the current detection unit 116, and a relationship of $Iin=Is\times\beta$ holds.

$\alpha$ is a transform coefficient for detecting the input voltage Vin as the input voltage detection value Vs by the voltage detection unit 115, and a relationship of $Vin=Vs\times\alpha$ holds.

Therefore, an input power limit value Plim is expressed by the following equation:

$$Plim=Vin\times\{-(R2/R1)\times\alpha Vin+(1+R2/R1)\times V2\}/\beta$$

As an example, R1=33 kΩ, R2=68 kΩ, V2=1.7, $\alpha$=0.011, and $\beta$=0.22. An input voltage range may be relatively narrow. For example, the input voltage range is 85 V or more and 120 V or less. In such a case, an input power limit value is 1260 W when the input voltage Vin is 85 V, and is 1350 W when the input voltage Vin is 120 V. Therefore, a difference between the upper limit and the lower limit of the input power limit value is 90 W.

Then, the input voltage range may be 85 V or more and 200 V or less. In such a case, the input power limit value is 600 W when the input voltage Vin is 200 V. Therefore, a difference in the input power limit value from when the input voltage Vin is 120 V is 750 W (FIG. 22).

Even if 1200 W is required as the power of the fixing device 7 when the input voltage is 200 V, therefore, the input power is limited at a time point where it reaches 600 W. Therefore, no required power is obtained.

In order to limit the power at an appropriate power value, there is a method for providing a multiplier within the input current limit value calculation circuit and putting the detected input voltage and input current into the multiplier. However, the cost of the multiplier is high, and a circuit configuration also becomes complicated.

SUMMARY OF THE INVENTION

The present invention is directed to an induction heating apparatus capable of preventing an excessive temperature rise of a conductive heating element in a simple configuration and appropriately even when an input voltage of an AC power supply differs according to countries and areas. The present invention is further directed to an induction heating apparatus capable of preventing an excessive temperature rise of a conductive heating element while sharing a configuration of a power supply device even when an input voltage of an AC power supply differs according countries and areas.

According to an aspect of the present invention, an induction heating apparatus includes a current supply unit configured to supply a high-frequency current to a coil for inductively heating a conductive heating element based on a direct current obtained by rectifying AC power supplied from an AC power supply, a driving unit configured to output a drive pulse for supplying the high-frequency current from the current supply unit, a voltage detection unit configured to detect an input voltage of the AC power supply, a current detection unit configured to detect an input current of the current supply unit, a temperature detection unit configured to detect a temperature of the conductive heating element, a control unit configured to control a frequency of the drive pulse output by the driving unit based on an output of the temperature detection unit, an output of the voltage detection unit, and an output of the current detection unit, and a power limiting unit configured to limit an operation of the driving unit when input power determined based on the output of the voltage detection unit and the output of the current detection unit exceeds a predetermined value, wherein the power limiting unit includes a first limiting circuit, corresponding to a first input voltage range, for determining that the input power exceeds the predetermined value based on the output of the voltage detection unit and the output of the current detection unit, and a second limiting circuit, corresponding to a second input voltage range higher than the first range, for determining that the input power exceeds the predetermined value based on the output of the voltage detection unit and the output of the current detection unit, wherein a degree of a change in an input current limit value, which is a value of the input current at which the input power is determined to exceed the predetermined value, relative to a change in the input voltage in the first limiting circuit is greater than a degree of a change in the input current limit value relative to a change in the input voltage in the second limiting circuit, and wherein the power limiting unit limits the operation of the driving unit in response to a signal indicating that the input power exceeds the predetermined value being output from each of the first limiting circuit and the second limiting circuit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1A:
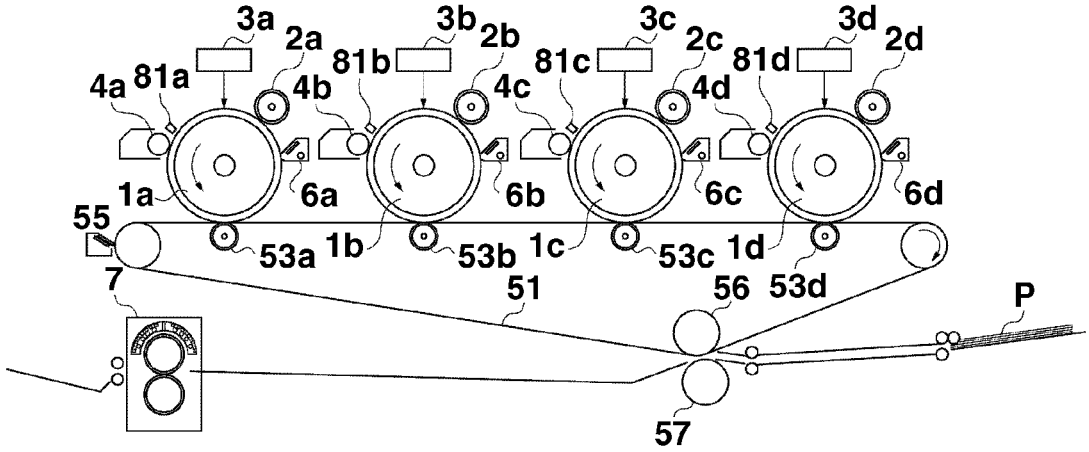
FIGS. 1A and 1B respectively illustrate configurations of an image forming apparatus.

FIG. 1A illustrates a configuration of a color image forming apparatus according to an exemplary embodiment of the present invention. The image forming apparatus uses an electrophotographic process.

In FIG. 1A, the image forming apparatus includes photosensitive members 1*a* to 1*d*, primary charging units 2*a* to 2*d*, exposure units 3*a* to 3*d*, development units 4*a* to 4*d*, primary transfer units 53*a* to 53*d*, cleaners 6*a* to 6*d*, an intermediate transfer belt 51, an intermediate transfer belt cleaner 55, and secondary transfer units 56 and 57. Components denoted by the symbols respectively including the subscripts a to d are for colors such as yellow, magenta, cyan, and black. In the following description, the subscripts a to d are omitted in the component common among the colors. The primary charging unit 2 uniformly charges the photosensitive member 1, and the exposure unit 3 then performs exposure corresponding to an image signal, so that an electrostatic latent image is formed on the photosensitive member 1. Then, the development unit 4 develops a toner image, the primary transfer unit 53 multiple-transfers the toner image on the photosensitive member 1 onto the intermediate transfer belt 51, and the secondary transfer units 56 and 57 further transfer the toner image as a full color image on sheets P. The cleaner 6 recovers toner remaining on the photosensitive member 1, and the intermediate transfer belt cleaner 55 recovers residual transfer toner remaining on the intermediate transfer belt 51. A fixing unit 7 fixes the toner image transferred on the sheets P. The fixing unit 7 uses an electromagnetic induction heating system.

Figure 1B:
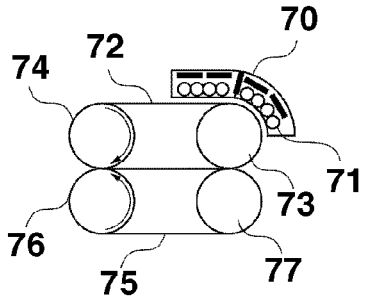

FIG. 1B illustrates a configuration of the fixing unit 7 using the electromagnetic induction heating system. Belts 72 and 75 respectively include conductive heating elements FB, and rotate in directions indicated by arrows with rollers 73, 74, 76, and 77 used as axes. A coil 71 is arranged opposite to the belt 72 within a coil holder 70. A high-frequency AC current flows through the coil 71 so that a magnetic field is generated. The conductive heating element FB in the belt 72 self-generates heat.

Figure 2:
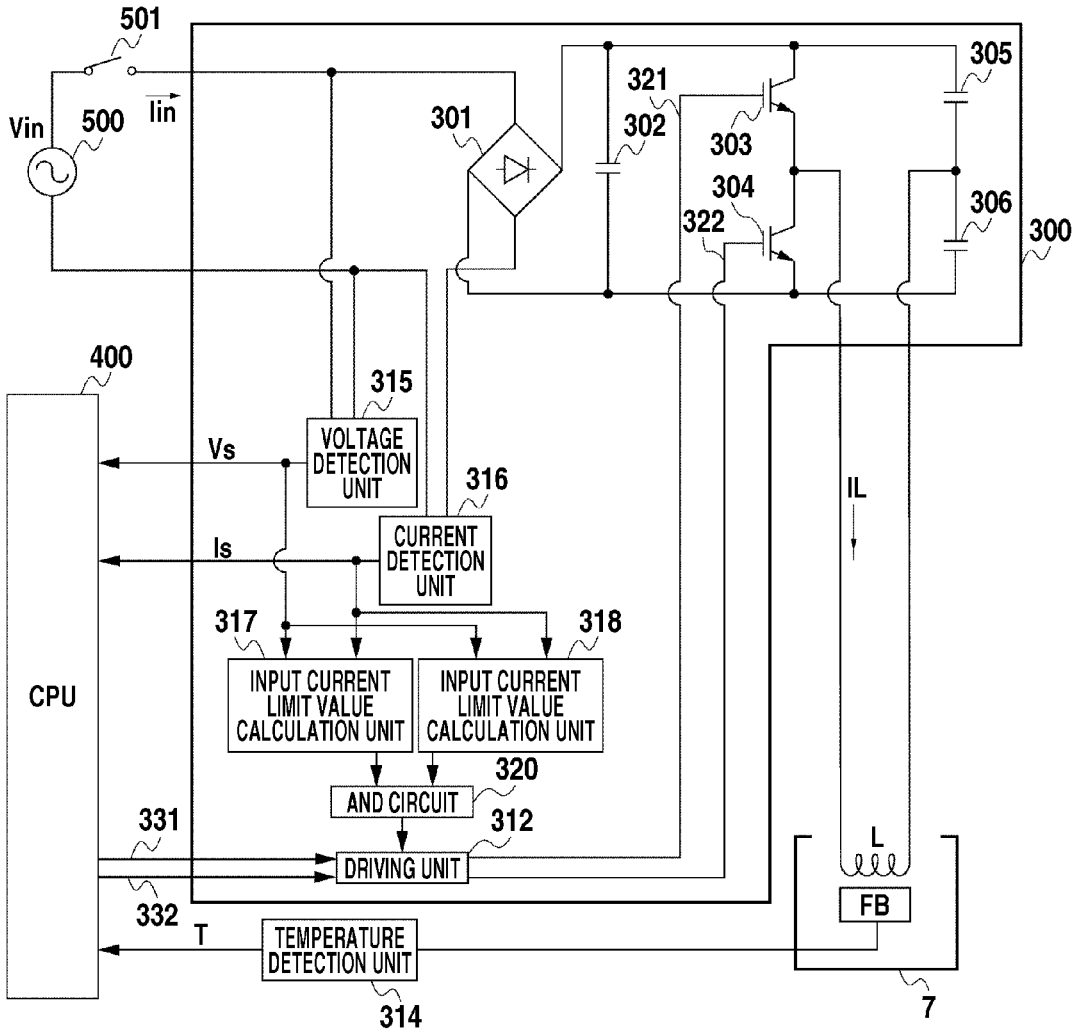
FIG. 2 illustrates a configuration of a fixing unit and a power supply device in a first exemplary embodiment of the present invention.

FIG. 2 illustrates a schematic configuration of the fixing unit 7 using the electromagnetic induction heating system and a power supply device 300 in a first exemplary embodiment of the present invention. The power supply device 300 is connected to a commercial power supply 500 via a power supply switch 501. When the power supply switch 501 is turned on, AC power is supplied from the commercial power supply 500 to the power supply device 300. The power supply device 300 includes a diode bridge 301, a filter capacitor 302, and first and second resonance capacitors 305 and 306 that form a resonance circuit, and a coil L. The power supply device 300 further includes first and second switch elements 303 and 304, a driving unit 312 for driving each of the switch elements, an input voltage detection unit 315 for detecting an input voltage Vin, an input current detection unit 316 for detecting an input current Iin, and a temperature detection unit 314 for detecting the temperature of the heating element FB. A detection value Vs of the input voltage detection unit 315 may be hereinafter abbreviated as an input voltage Vs, and a detection value Is of the input current detection unit 316 may be hereinafter abbreviated as an input current Is.

The diode bridge 301 rectifies the AC power supplied from the AC power supply 500. The filter capacitor 302 smoothes the AC power, and converts the AC power into a direct current. The first and second switch elements 303 and 304 switch the direct current obtained by the conversion, to generate a high-frequency current and supply the high-frequency current to the coil L. More specifically, the diode bridge 301, the filter capacitor 302, the first and second resonance capacitors 305 and 306, and the first and second switch elements 303 and 304 function as a current supply unit for supplying a high-frequency current to the coil L. The driving unit 312 generates high-frequency drive pulses 321 and 322.

A CPU 400 serves as a control unit for controlling a series of operations of the image forming apparatus. The CPU 400 determines the driving frequencies of the drive pulses 321 and 322 output by the driving unit 312 from the detection values of the input voltage detection unit 315, the input current detection unit 316, and the temperature detection unit 314, and outputs driving signals 331 and 332 for the drive pulses to the power supply device 300. The driving frequencies of the drive pulses 321 and 322 are the same, and the signal levels thereof are reversed.

Figure 3:
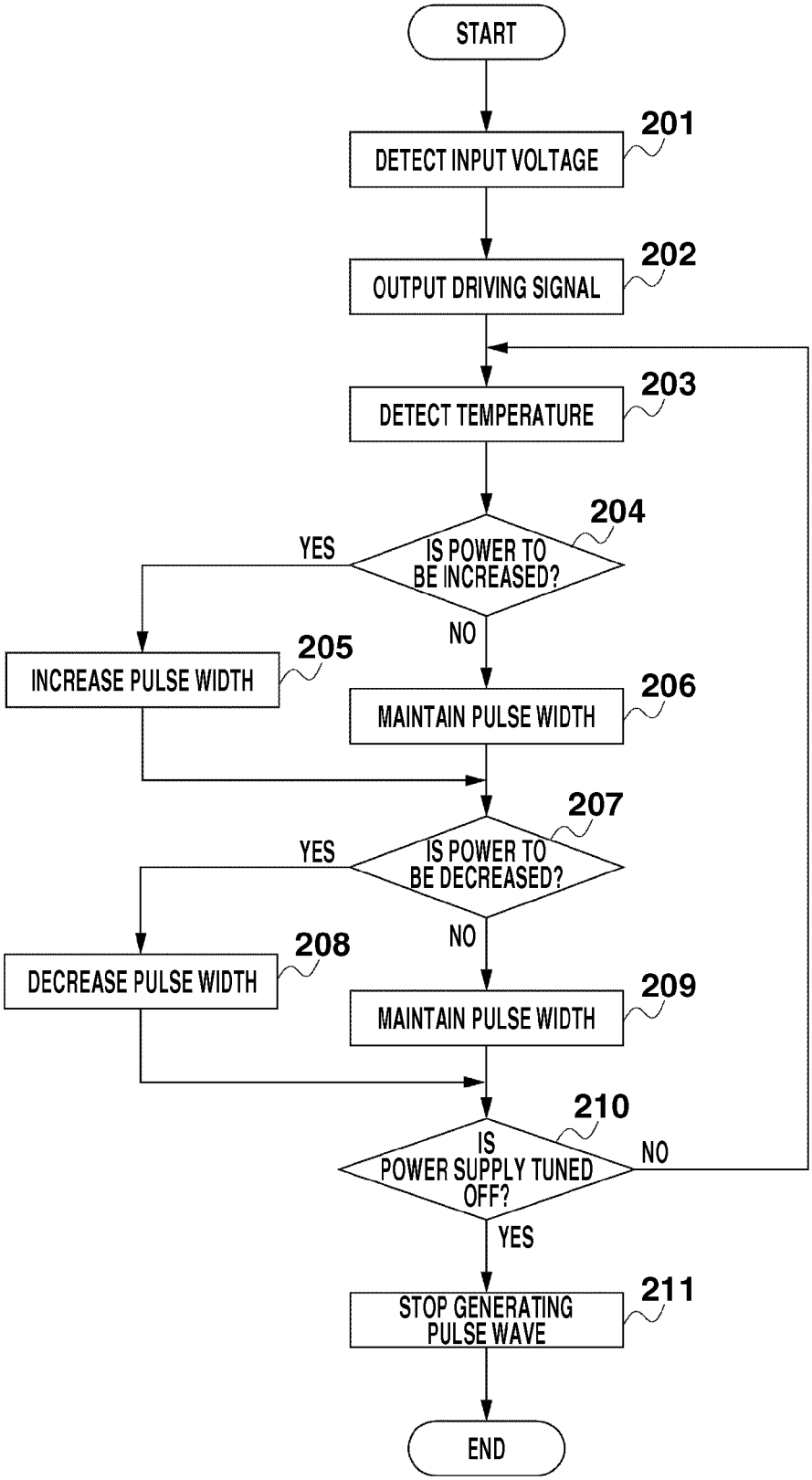
FIG. 3 is a flowchart illustrating temperature control of a fixing unit.

FIG. 3 is a flowchart illustrating detailed operations relating to control of the power supply device 300 by the CPU 400.

If the power supply switch 501 is first turned on to turn on the commercial power supply 500, the processing proceeds to step 210. In step 201, the CPU 400 detects an input voltage from the commercial power supply 500 by the input voltage detection unit 315 and the temperature of the conductive heating element FB by the temperature detection unit 314. In step 202, the CPU 400 sends out to the driving unit 312 the driving signals 331 and 332 having the driving frequencies corresponding to power determined based on the detected input voltage and temperature. In step 203, the CPU 400 then periodically detects the temperature of the conductive heating element FB by the temperature detection unit 314.

In steps 204 and 207, the CPU 400 determines whether input power required for the fixing unit 7 is increased and decreased based on the result of the temperature detection. If the input power is increased (YES in step 204), the processing proceeds to step 205. In step 205, the CPU 400 increases the pulse widths of the driving signals 331 and 332. If the input power is decreased (YES in step 207), the processing proceeds to step 208. In step 208, the CPU 400 decreases the pulse widths. If the input power need not be changed (NO in steps 204 and 207), the processing proceeds to steps 206 and 209. In steps 206 and 209, the CPU 400 maintains the pulse widths. In step 210, the CPU 400 determines whether the power supply switch 501 is turned off. If the power supply switch 501 is turned off (YES in step 210), the processing proceeds to step 211. In step 211, the CPU 400 stops sending out a pulse wave.

Even if the power supply switch 501 is turned off, a CPU power supply (not illustrated) maintains an output for a predetermined period of time. The driving signals 331 and 332 for the driving pulses are output so that an ON period and an OFF period become equal. The increase in the pulse widths of the driving signals 331 and 332 corresponds to the decrease in the driving frequencies of the driving signals 331 and 332, and the decrease in the pulse widths corresponds to the increase in the driving frequencies. Although the minimum values of the driving frequencies of the driving signals 331 and 332 are resonant frequencies determined by the coil L and the capacitors 305 and 306, they may be frequencies slightly higher than the resonant frequencies.

The driving unit 312 outputs the drive pulses 321 and 322 upon receipt of the driving signals 331 and 332 from the CPU 400, and drives the switch elements 303 and 304. The power supply device 300 includes input current limit value calculation circuits 317 and 318 for limiting an input current independently of the control by the CPU 400. Input current limit values, with respect to the input voltage, in the input current limit value calculation circuits 317 and 318 are respectively set to different levels. More specifically, each of the input current limit value calculation circuits 317 and 318 corresponds to a plurality of input voltage ranges (a 100-V input voltage range and a 200-V input voltage range).

In the present exemplary embodiment, maximum input power required for the fixing unit 7 when the CPU 400 is normally operating is 1200 W. In the input current limit value calculation circuit 317, constants are set so that input power is limited when it reaches a predetermined value, e.g., 1300 to 1400 W if the input voltage of the commercial power supply 500 is in a range of 85 V or more and less than 150 V (a first range). In the input current limit value calculation circuit 318, constants (resistance values and reference values for comparison) are set so that input power is limited when it reaches 1300 W to 1400 W if the input voltage of the commercial power supply 500 is in a range of 150 V or more and 264 V or less (a second range).

Figure 4A:
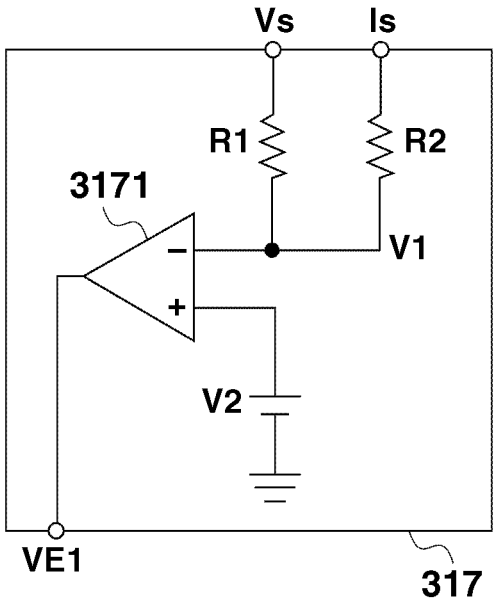
FIGS. 4A and 4B respectively illustrate configurations of input current limit value calculation circuits.

FIG. 4A illustrates the details of the input current limit value calculation circuit 317 in the present exemplary embodiment. A signal line (an input voltage Vs) from the input voltage detection unit 315 and a signal line (an input current Is) from the input current detection unit 316 are respectively connected to resistors R1 and R2. The resistors R1 and R2 are connected in parallel. A voltage V1 at a junction of the resistors R1 and R2 is input to a comparator 3171, and is compared with a threshold value V2. An output VE1 of the comparator 3171 is input to an AND circuit 320.

In the configuration illustrated in FIG. 4A, the voltage V1 is expressed by the following equation:

$$V1=(R1\times Is+R2\times Vs)/(R1+R2)$$

The resistors R1 and R2 are set so that the voltage V1 is lower than the threshold value V2 while the CPU 400 is normally operating. When the CPU 400 normally operates, the output VE1 of the comparator 3171 is "L" (at low level). When the CPU 400 runs away, for example, so that an input current Iin increases, however, an input current detection value Is increases, and thus the voltage V1 also increases. The output VE1 becomes "H" (at high level) when V1>V2. An input current limit value I2 obtained at this time is expressed by the following equation:

$$I2=-(R2/R1)\times Vs+\{(R1+R2)/R1\}\times V2$$

Figure 5A:
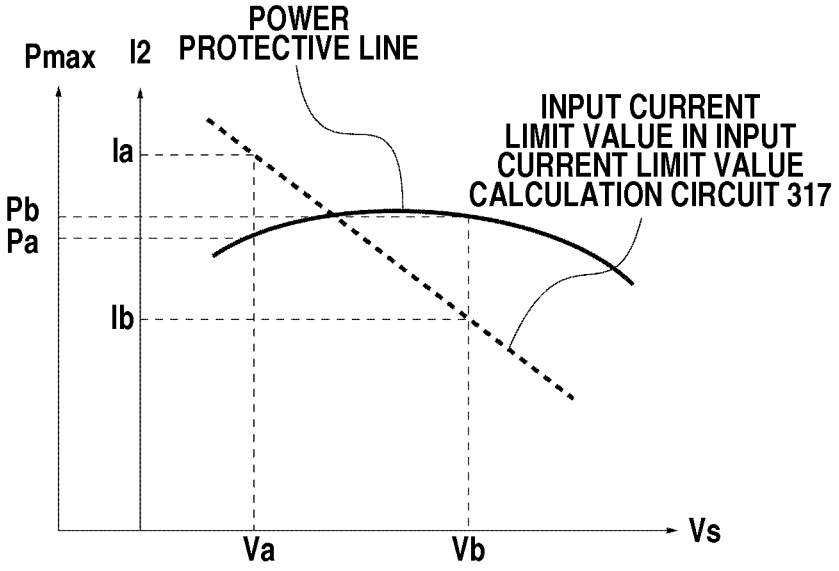
FIGS. 5A and 5B respectively illustrate characteristics of input current limit values with respect to an input voltage.

FIG. 5A illustrates a relationship of an input voltage detection value Vs, an input current limit value I2, and an input power limit value Pmax based on the voltage V1 and the input current limit value I2. When the input voltage detection value Vs increases, the input current limit value I2 decreases. More specifically, a change in the input voltage detection value Vs and a change in the input current limit value I2 are inversely related to each other and is expressed by a primary expression. An input current limit value Ia obtained when the input voltage detection value Vs is Va (85 V≦Va<150 V) is expressed by the following equation:

$$Ia=-(R2/R1)\times\alpha Va+\{(R1+R2)/R1\}\times V2$$

Accordingly, an input power limit value Pa obtained when the input voltage detection value Vs is Va is expressed by the following equation:

$$Pa=(Va/\beta)\times[-(R2/R1)\times\alpha Va+\{(R1+R2)/R1\}\times V2]$$

Similarly, an input current limit value Ib (<Ia) and an input power limit value Pb (≡Pa) obtained when the input voltage detection value Vs is Vb (85 V≦Va<Vb<150 V) are respectively expressed by the following equations:

$$Ib=-(R2/R1)\times\alpha Vb+\{(R1+R2)/R1\}\times V2$$

$$Pb=(Vb/\beta)\times[-(R2/R1)\times\alpha Vb+\{(R1+R2)/R1\}\times V2]$$

Figure 4B:
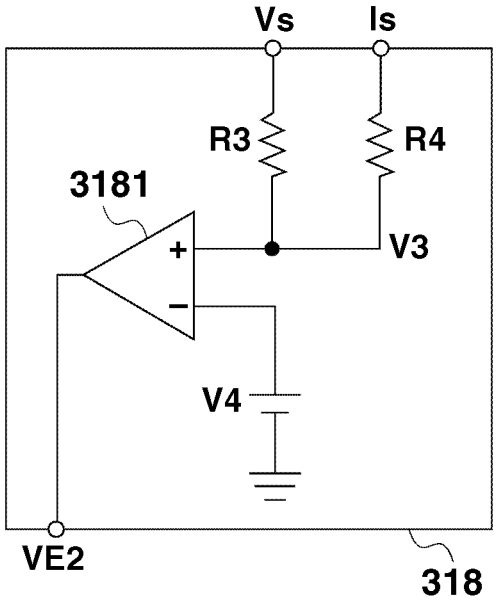

FIG. 4B illustrates the details of the input current limit value calculation circuit 318 in the present exemplary embodiment. While the input current limit value calculation circuit 318 differs from the input current limit value calculation circuit 317 in a value (a constant) of each element, it is similar to the input current limit value calculation circuit 317 in an operation and a circuit configuration. As in the input current limit value calculation circuit 317, a threshold value V4 illustrated in FIG. 4B and an input current limit value I4 in the input current limit value calculation circuit 318 are expressed by the following equations:

$$V3=(R3\times Is+R4\times Vs)/(R3+R4)$$

$$I4=-(R4/R3)\times Vs+\{(R3+R4)/R3\}\times V4$$

Constants (resistance values and reference values) are set so that respective straight lines of the input current limit values I2 and I4 differ in slope, both the X- and Y-coordinates of an intersection of the two straight lines are positive, and the straight line slops downwards (is inversely proportional to the input voltage detection value Vs). More specifically, the degree of a change in the input current limit value in the first range of 85 V or more and less than 150 V is lower than the degree of a change in the input current limit value in the second range of 150 V or more and 264 V or less. More specifically, a primary expression of the input current limit value is in an inverse relationship regardless of whether the input voltage is in the first range or the second range, and the slope of the primary expression in the first range is greater than the slope of the primary expression in the second range, as illustrated in FIG. 5B.

As in the input current limit value calculation circuit 317, an output VE2 of a comparator 3181 is input to the AND circuit 320. An output VE of the AND circuit 320 becomes "H" when both the outputs VE1 and VE2 become "H", to limit the operation of the driving unit 312. More specifically, when the output VE is "H", the driving unit 312 forces the drive pulses 321 and 322 to stop regardless of the driving signals 331 and 332 from the CPU 400.

Figure 5B:
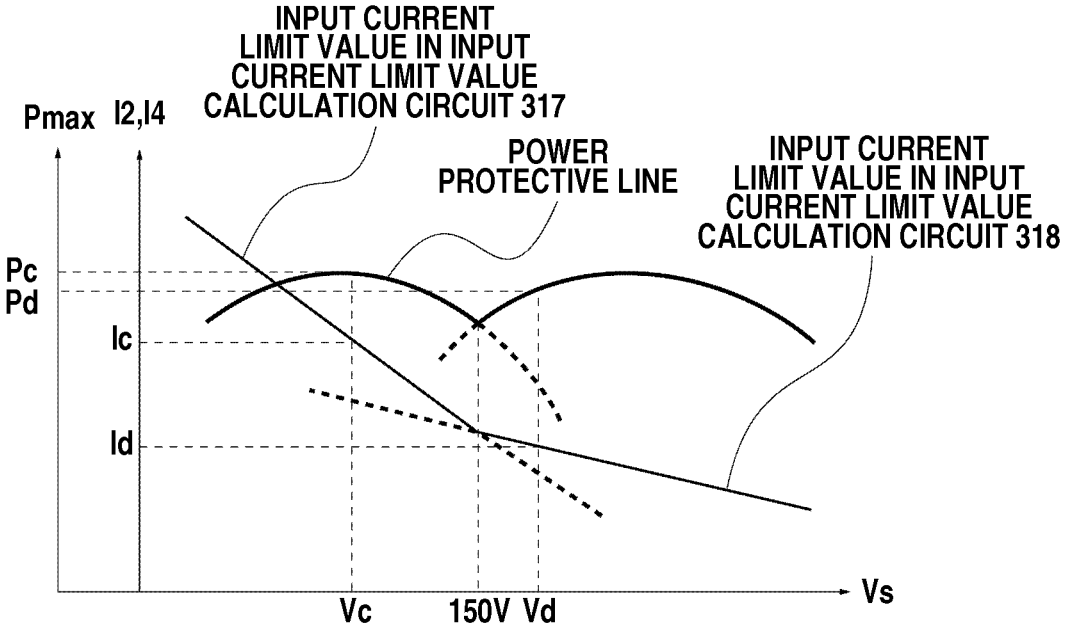

FIG. 5B illustrates a relationship of the detection value Vs of the input voltage Vin (the input voltage Vs) to the input current limit value I2 or I4 and the input power limit value Pmax in the configuration illustrated in FIG. 2. Characteristics of a change in the input current limit value I2 or I4 to the input voltage detection value Vs differ for each of a plurality of input voltage ranges (85 to 150 V, 150 to 264 V). The higher the input voltage range (150 to 264 V), the smaller the change in the input current limit value I2 or I4 (the slope of the primary expression serving as a characteristic straight line).

When the input voltage detection value Vs is Vc (85 V≦Vc<150 V), the input current limit value I2 is Ic, and the input power limit value Pmax is Pc. If the input current detection value Is is Ic or less, the output VE1 of the comparator 3171 becomes "L". Accordingly, the output VE of the AND circuit 320 becomes "L" regardless of the output VE2 of the comparator 3181, so that the driving unit 312 operates. If the input current detection value Is exceeds Ic, the output VE1 of the comparator 3171 becomes "H". At this time, in the input current limit value calculation circuit 318, the input current detection value Is has already exceeded an input current limit value Id. Therefore, the output VE2 of the comparator 3181 also becomes "H". Accordingly, the output of the AND circuit 320 becomes "H", so that the operation of the driving unit 312 is limited. More specifically, the driving unit 312 forces the drive pulses 321 and 322 to stop.

When the input voltage detection value Vs is Vd (150 V≦Vd≦264 V), the input current limit value I4 is Id (<Ic), and the input power limit value Pmax is Pd (≡Pc). If the input current detection value Is is Id or less, the output VE2 of the comparator 3181 becomes "L". Accordingly, the output VE of the AND circuit 320 becomes "L" regardless of the output VE1 of the comparator 3171, so that the driving unit 312 operates. If the input current detection value Is exceeds Id, the output VE2 of the comparator 3181 becomes "H". At this time, in the input current limit value calculation circuit 317, the input current limit value I2 is lower than Id, as can be seen from FIG. 5B. Therefore, the output VE1 of the comparator 3171 also becomes "H". Accordingly, the output of the AND circuit 320 becomes "H". Therefore, the driving unit 312 forces the drive pulses 321 and 322 to stop.

Thus, the input current limit value calculation circuits 317 and 318 and the AND circuit 320 function as a power limiting unit for limiting the operation of the driving unit 312. The input current limit value calculation circuits 317 and 318 function as first and second limiting units included in the power limiting unit.

Figure 6:
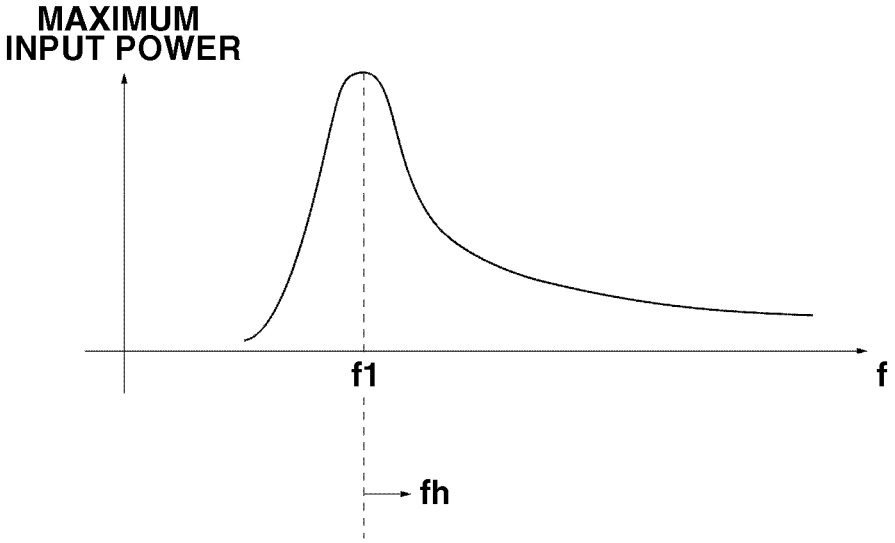
FIG. 6 is a diagram illustrating a relationship between a driving frequency and power.

The CPU 400 outputs the driving signals 331 and 332 according to an operation sequence of the image forming apparatus. In a frequency region fh higher than a resonance frequency f1 determined by the inductance of the coil L and the resonance capacitors 305 and 306, the input power of the power supply device 300 is increased if the driving frequencies are decreased, while being decreased if the driving frequencies are increased (FIG. 6).

If the temperature detected by the temperature detection unit 314 is lower than its target temperature, the CPU 400 calculates input power based on detection results from the input voltage detection unit 315 and the input current detection unit 316. If the calculated input power is lower than maximum power previously set, the CPU 400 increases the pulse widths of the driving signals 331 and 332 so that the frequencies of the drive pulses 321 and 322 are decreased, to increase power (input power) to be supplied to the fixing unit 7. If the input power is higher than the maximum power, the CPU 400 decreases the input power to the maximum power so that the frequencies are decreased.

On the other hand, if the temperature detected by the temperature detection unit 314 is higher than the target temperature, the CPU 400 decreases the pulse widths of the driving signals 331 and 332 to increase the frequencies of the drive pulses 321 and 322, to decrease the input power.

By repeating the above-mentioned operations, the CPU 400 controls the heating element FB so that the temperature thereof becomes its target temperature. The input current limit value calculation circuit 317 monitors the voltage V1 found from the input voltage detection value Vs detected by the input voltage detection unit 315 and the input current detection value Is detected by the input current detection unit 316. The input current limit value calculation circuit 318 monitors a voltage V3 found from the input voltage detection value Vs detected by the input voltage detection unit 315 and the input current detection value Is detected by the input current detection unit 316.

Operations performed when the CPU 400 is normally operating will be described below. First consider the 100-V commercial power supply in which the input voltage Vin thereof is in a range of 85 V or more and 150 V or less (the peak value of the input voltage Vin is Vp1).

Figure 7:
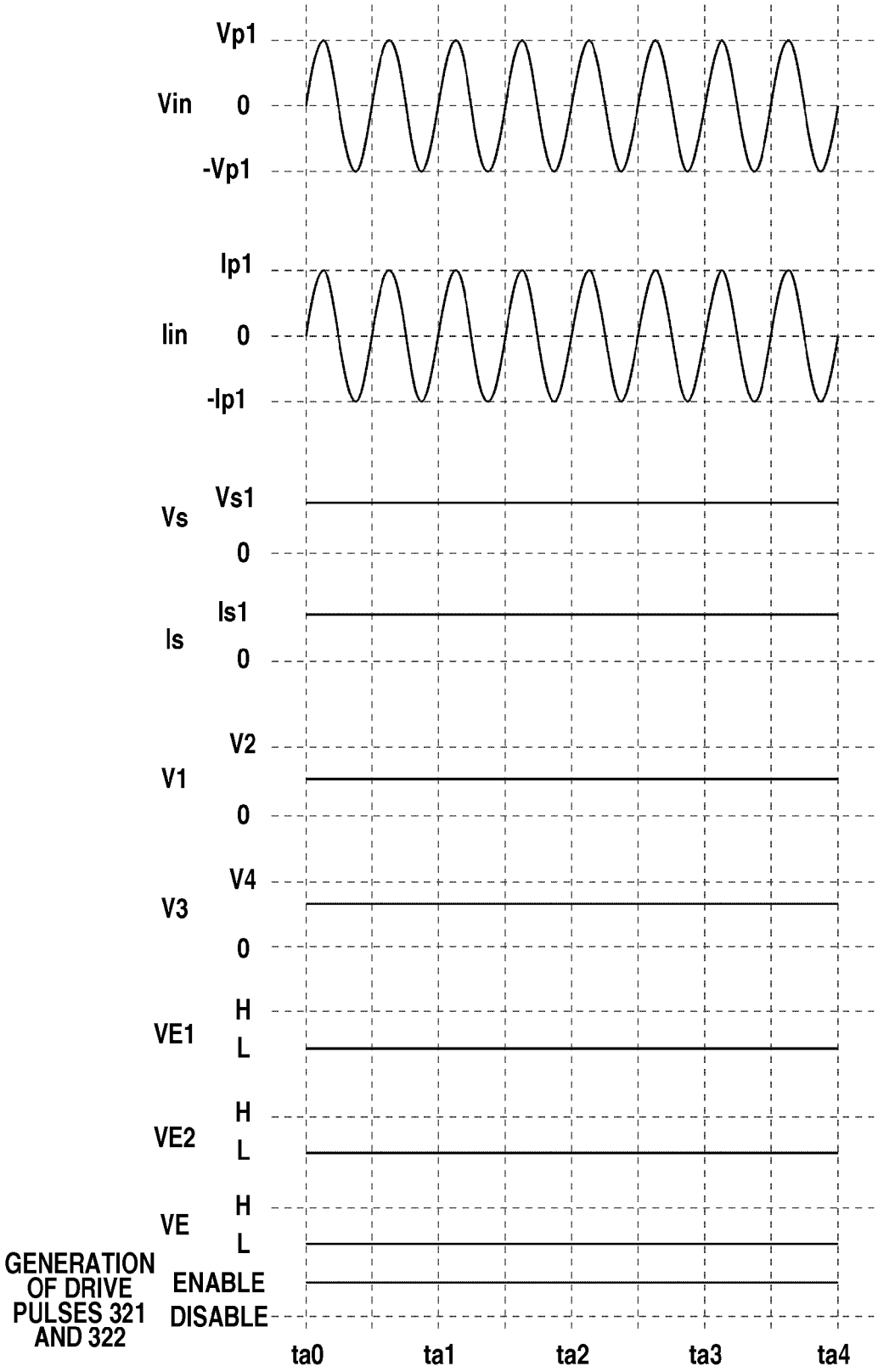
FIG. 7 illustrates a waveform of each unit in a power supply device when a CPU normally operates in 100-V input.

FIG. 7 illustrates respective waveforms of an input voltage Vin and an input current Iin and their detection values Vs and Is when input power is lower than an input power limit value, and the peak value of the input current Iin is Ip1 from time ta0 to time ta4. Voltages V1 and V3 found from the detection values Vs and Is are respectively lower than reference values V2 and V4 for comparison. Accordingly, both error signals VE1 and VE2 exhibit "L", and an output VE of the AND circuit 320 also exhibits "L" indicating that it is normal.

Figure 8:
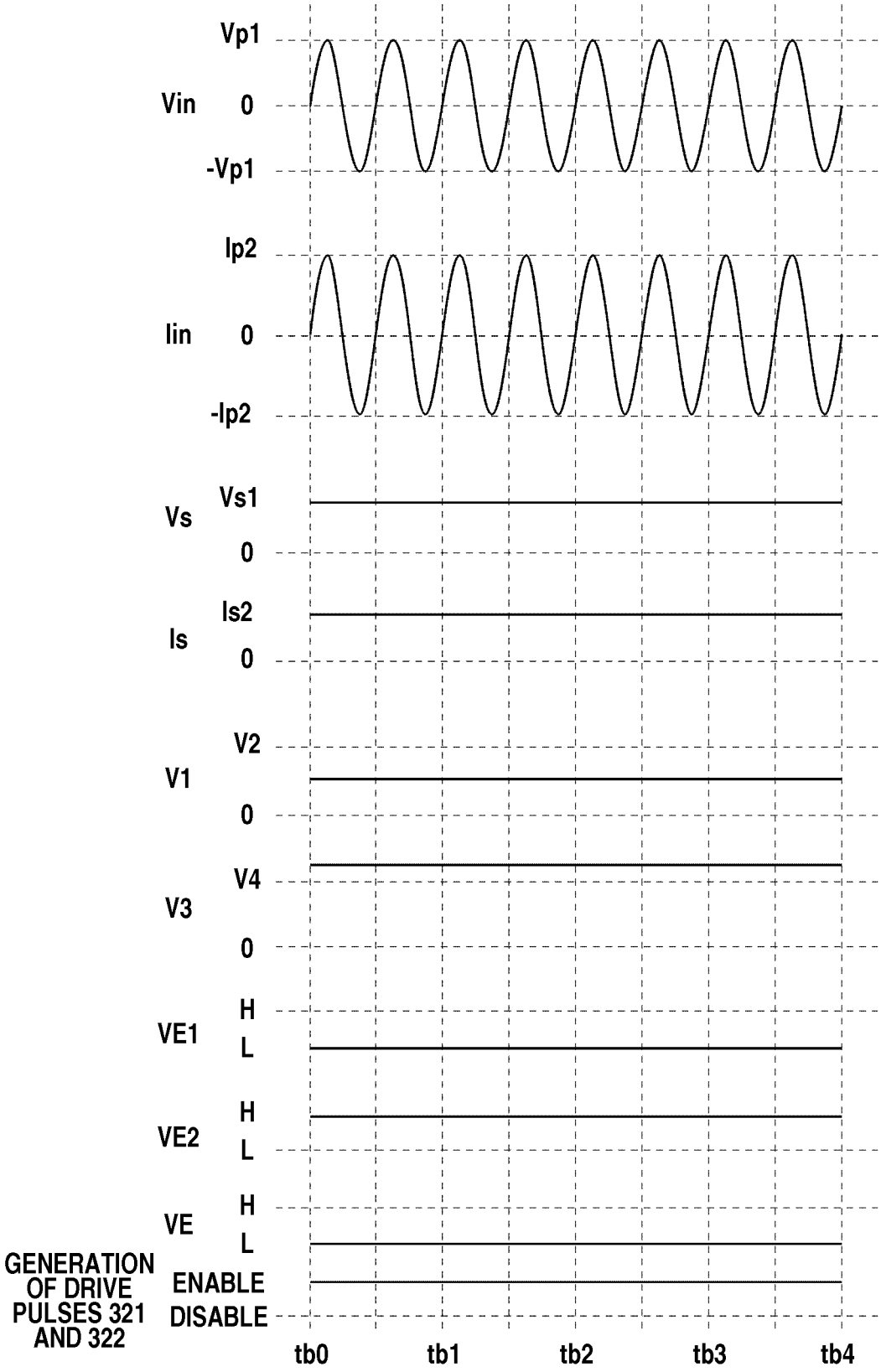
FIG. 8 illustrates a waveform of each unit in a power supply device when input power is increased in 100-V input.

FIG. 8 illustrates respective waveforms of an input voltage Vin and an input current Iin and their detection values Vs and Is when the maximum value of an input current Iin increases to a value Ip2 at time tb0 so that input power is increased. In the input current limit value calculation circuit 318, a voltage V3 found from the detection values Vs and Is becomes higher than a limit value V4, so that an error signal VE2 exhibits "H". On the other hand, in the input current limit value calculation circuit 317, a voltage V1 found from the detection values Vs and Is is lower than a limit value V2, so that an error signal VE1 exhibits "L". Accordingly, an output VE of the AND circuit 320 also exhibits "L" indicating that it is normal.

Figure 9:
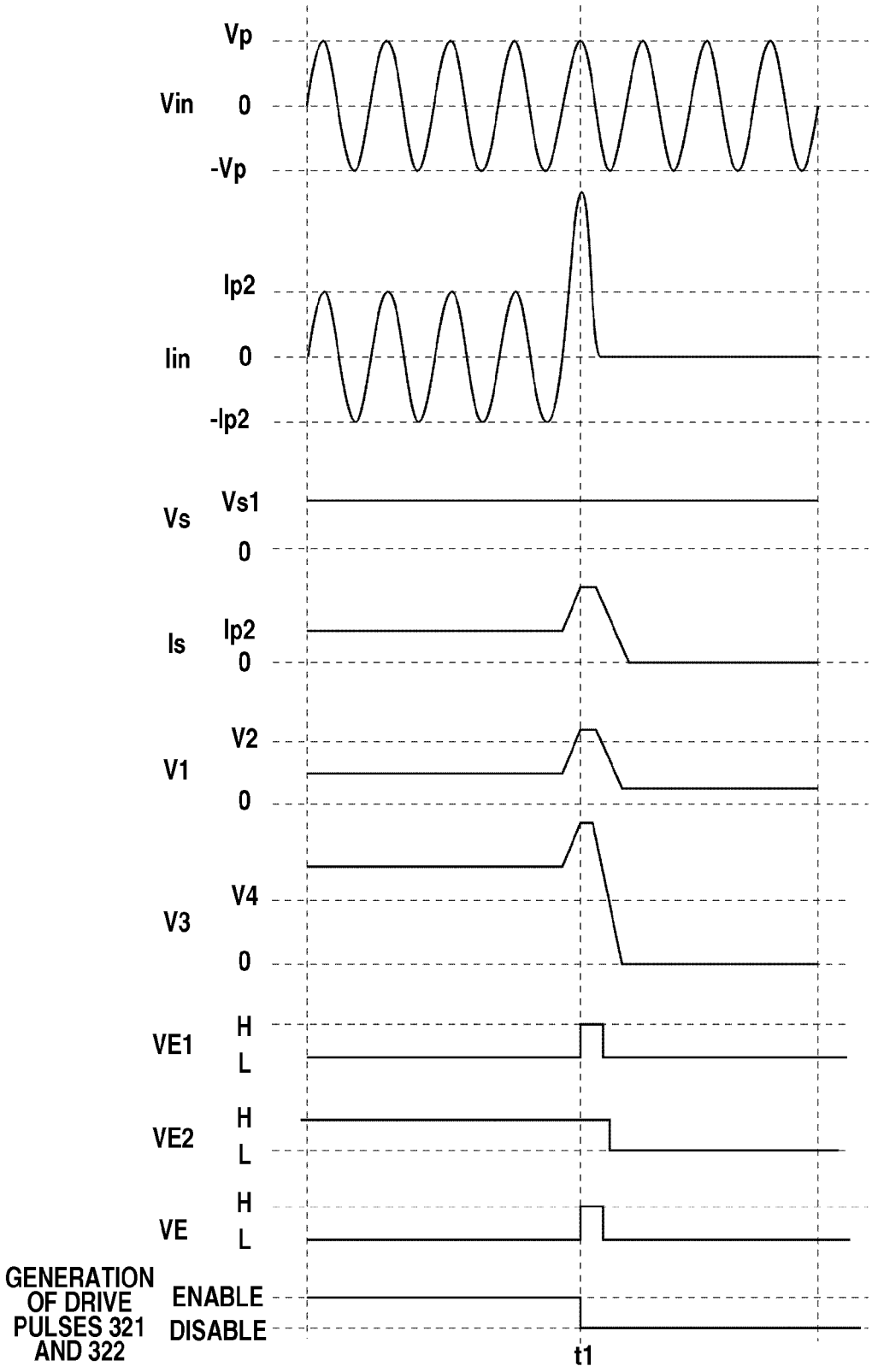
FIG. 9 illustrates a waveform of each unit in a power supply device when a CPU runs away in 100-V input.

FIG. 9 illustrates respective waveforms of an input voltage Vin and an input current Iin and their detection values Vs and Is when the CPU 400 runs away so that the peak value of the input current Iin exceeds the value Ip2 at time t1. When the input current Iin greatly exceeds the value Ip2, the input current detection value Is also increases, and correspondingly a voltage V1 also increases. When the voltage V1 exceeds a threshold value V2, both outputs VE1 and VE2 become "H" so that an output VE of the AND circuit 320 changes from "L" to "H". The driving unit 312 forces the drive pulses 321 and 322 to stop regardless of the driving signals 331 and 332 from the CPU 400.

Figure 10:
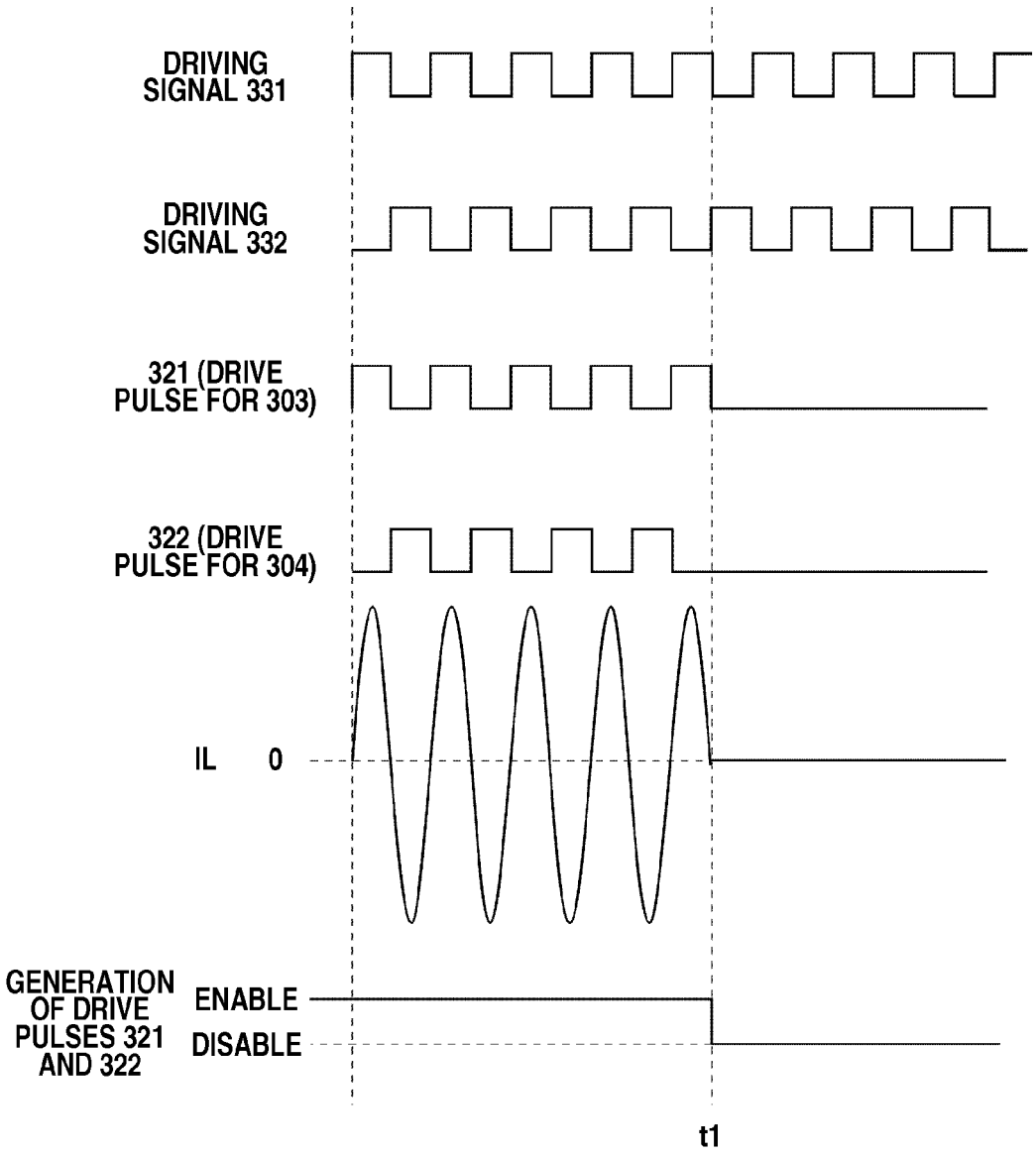
FIG. 10 illustrates a waveform of each unit in a power supply device when a CPU runs away in 100-V input.

FIG. 10 illustrates respective waveforms of the driving signals 331 and 332 and a current IL flowing through the coil L when the CPU 400 runs away. The driving signals 331 and 332 are half-period out of phase (there is actually provided a dead time corresponding to a period of time during which both the driving signals 331 and 332 are "L"). When the peak value of an input current Iin exceeds the value Ip2 at time t1 so that an output VE of the AND circuit 320 changes from "L" to "H", the driving unit 312 forces the drive pulses 321 and 322 to stop regardless of the driving signals 331 and 332 from the CPU 400, and the coil current IL also stops.

Then consider the 200-V commercial power supply 500 in which the input voltage Vin thereof is 150 V or more and 264 V or less (the maximum value of the input voltage Vin is Vp2).

Figure 11:
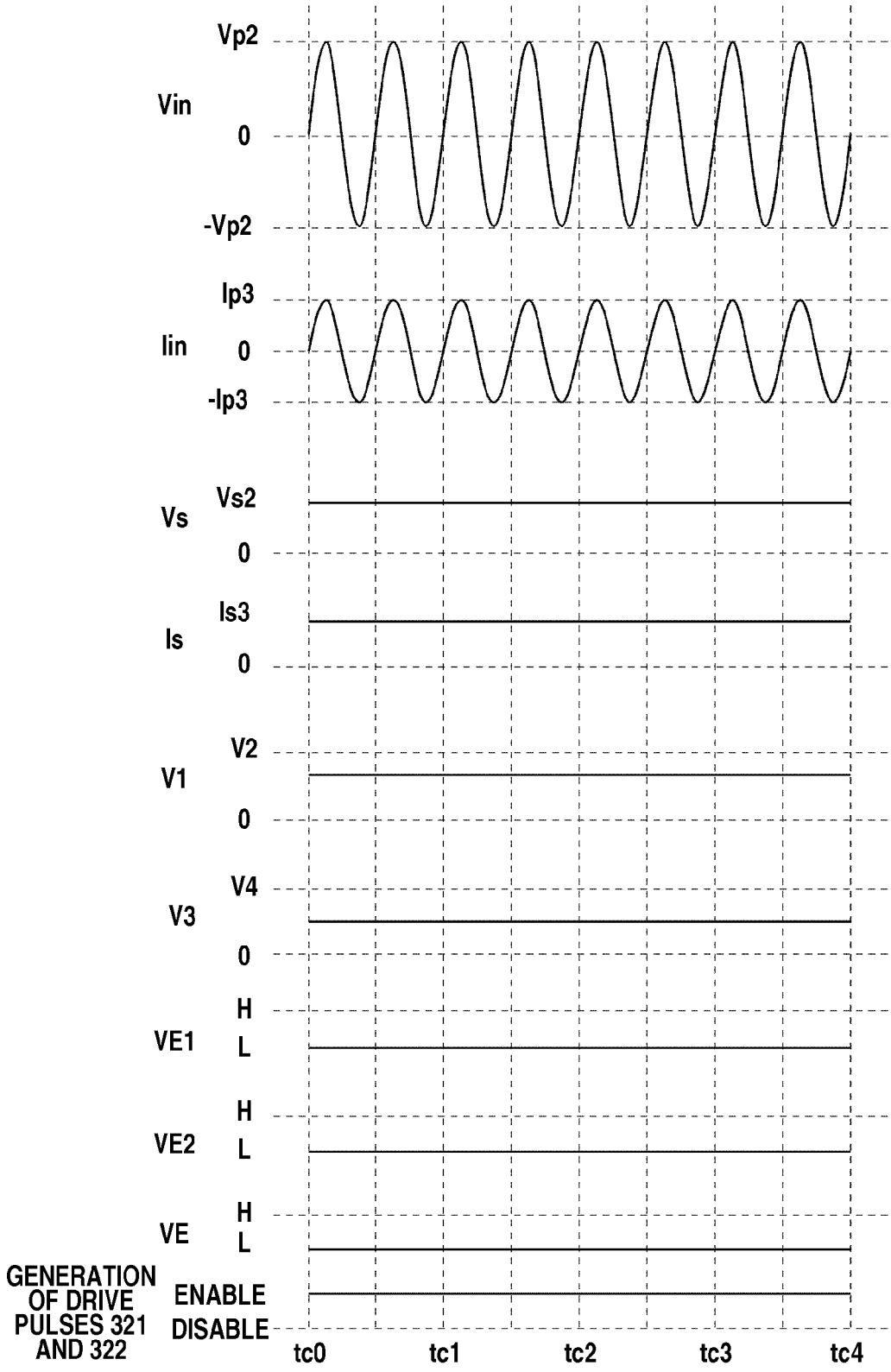
FIG. 11 illustrates a waveform of each unit in a power supply device when a CPU normally operates in 200-V input.

In FIG. 11, input power is lower than its limit value during a period from time tc0 to time tc4, and the maximum value of an input current Iin is Ip3. Voltages V1 and V3 found from detection value Vs and Is are respectively lower than reference values V2 and V4 for comparison. Accordingly, both error signals VE1 and VE2 exhibit "L", and an output VE of the AND circuit 320 also exhibits "L" indicating that it is normal.

Figure 12:
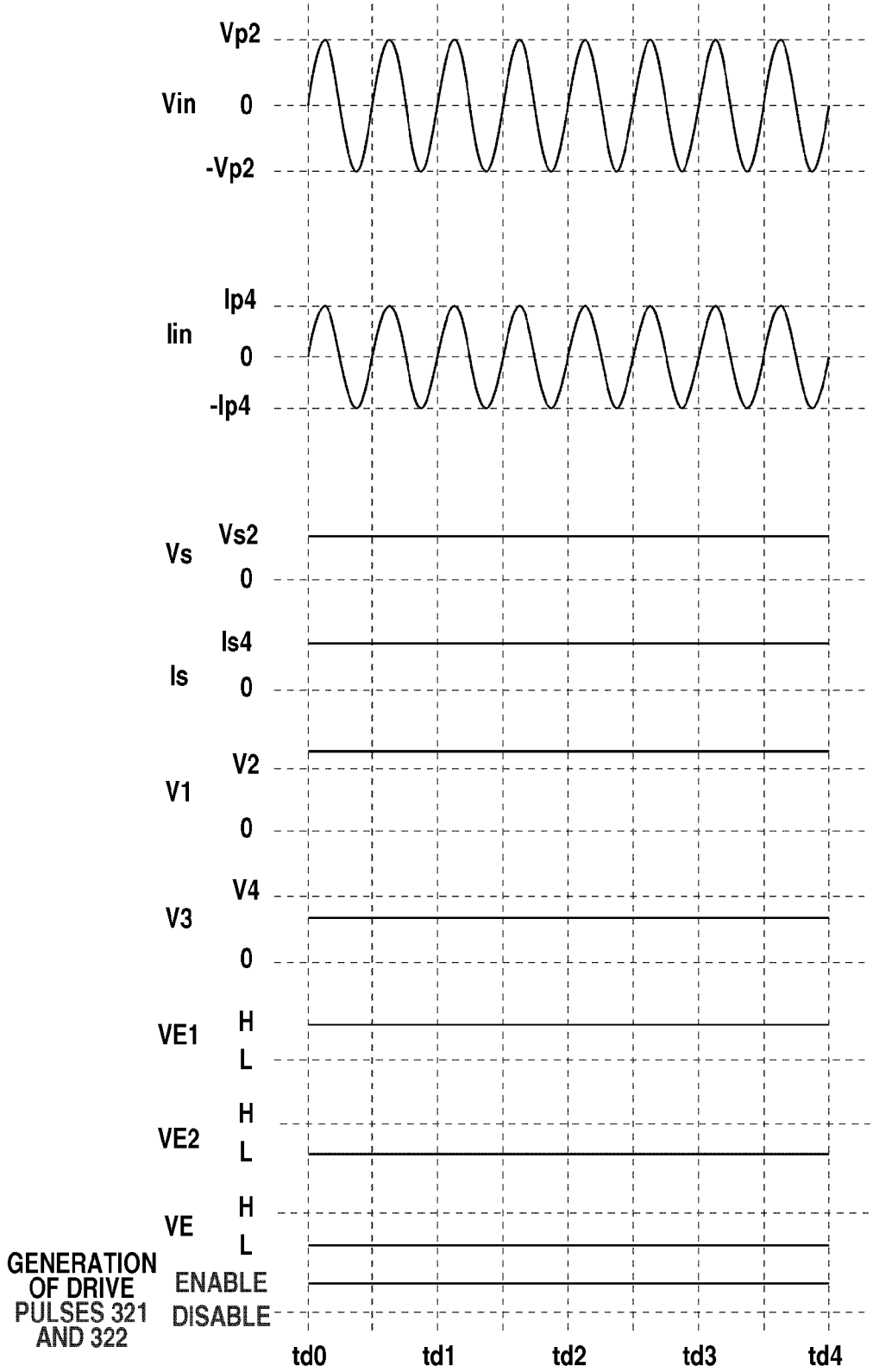
FIG. 12 illustrates a waveform of each unit in a power supply device when input power is increased in 200-V input.

In FIG. 12, the maximum value of an input current Iin increases to Ip4 (>Ip3) at time td0 so that input power is increased. A voltage V1 in the input current limit value calculation circuit 317 is higher than a limit value V2, so that an error signal VE1 exhibits "H". On the other hand, a voltage V3 in the input current limit value calculation circuit 318 is lower than a reference value V4, so that an error signal VE2 exhibits "L". Accordingly, an output VE of the AND circuit 320 exhibits "L" indicating that it is normal.

Figure 13:
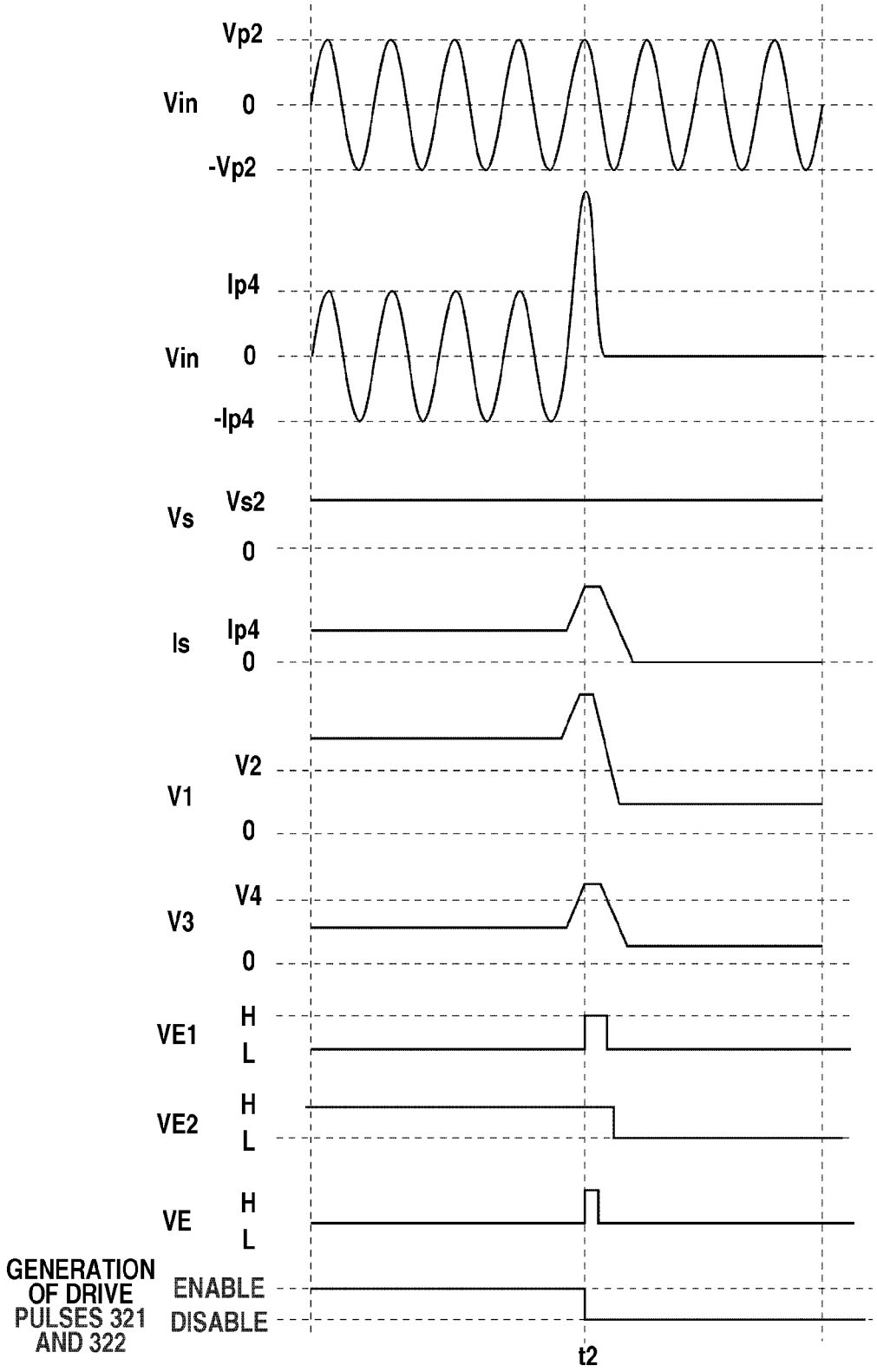
FIG. 13 illustrates a waveform of each unit in a power supply device when a CPU runs away in 200-V input.

In FIG. 13, the CPU 400 runs away during its operation, and the maximum value of an input current Iin exceeds Ip4 at time t2. When the input current Iin exceeds Ip4, an input current detection value Is also increases, and correspondingly a voltage V1 also increases. When a voltage V3 exceeds a reference value V4, both error signals VE1 and VE2 become "H" so that an output VE of the AND circuit 320 changes from "L" to "H". The driving unit 312 forces the drive pulses 321 and 322 to stop regardless of the driving signals 331 and 332 from the CPU 400. Respective waveforms of the driving signals 331 and 332 and the coil current IL when the CPU 400 runs away are similar to those in the operations of the 100-V commercial power supply 500 (FIG. 10).

According to the present exemplary embodiment, even when the CPU 400 runs away, the input power limit value can be made substantially constant by switching characteristics of the change in the input current limit value according to a voltage range including the input voltage Vin of the commercial power supply 500 in a simple circuit configuration. As a result, even when the configuration of the power supply device 300 is standardized among countries and areas that differ in the voltage of the AC power supply, a safety function can be correctly operated.

In a second exemplary embodiment of the present invention, an intermittent operation is performed as a protective operation when a CPU 400 runs away. Processing performed except when the CPU 400 runs away and a circuit configuration except an input current limit value calculation circuit are similar to those in the first exemplary embodiment. Therefore, the input current limit value calculation circuit and operations performed when the CPU 400 runs away will be described below.

Figure 14A:
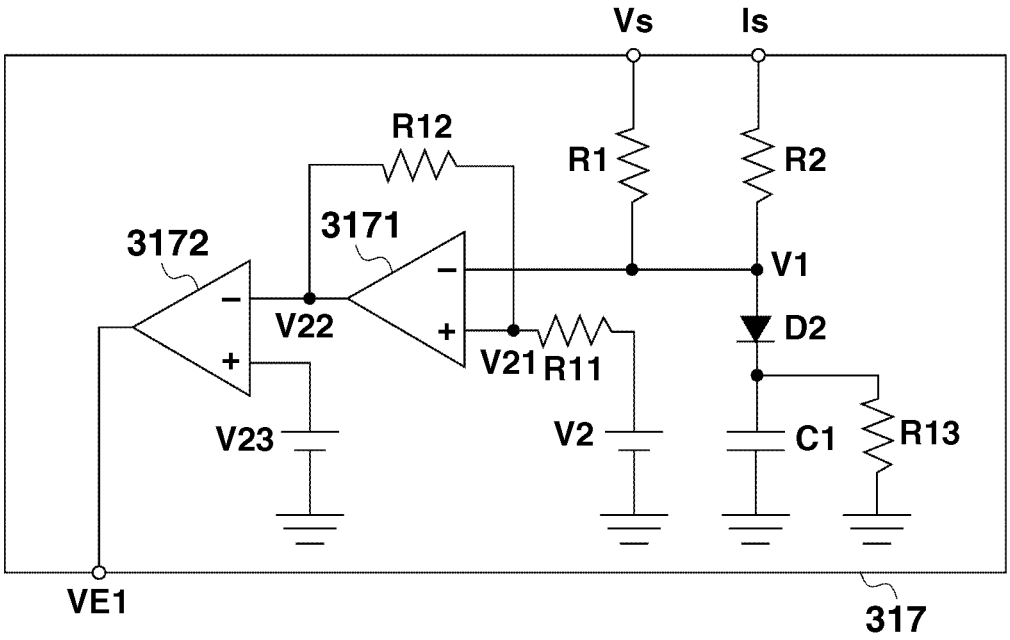
FIGS. 14A and 14B respectively illustrate configurations of input current limit value calculation circuits in a second exemplary embodiment of the present invention.

FIG. 14A illustrates the details of an input current limit value calculation circuit 317 in the present exemplary embodiment. A signal line from an input voltage detection unit 315 and a signal line from an input current detection unit 316 are respectively connected in series with resistors R1 and R2. A capacitor C1 is connected between a junction point of the resistors R1 and R2 and the ground, to delay a change in a voltage V1 by a predetermined period of time.

In the configuration illustrated in FIG. 14A, the voltage V1 at the junction point of the resistors R1 and R2 is expressed by the following equation using an input voltage detection value Vs, an input current detection value Is, and the resistors R1 and R2:

$$V1=(R1\times R13\times Is+R2\times R13\times Vs)/(R1\times R2+R2\times R13+R1\times R13)$$

The voltage V1 at the junction point of the resistors R1 and R2 is input to a comparator 3171, and is compared with a reference value V21. The reference value V21 varies according to an output V22 of the comparator 3171. In the present exemplary embodiment, the comparator 3171 is an open collector. More specifically, in the comparator 3171, when V1>V21, the output V22 of the comparator 3171 is in the grounded (low-level) state. When V1≦V21, the output V22 of the comparator 3171 is in the open state, in which the output V22 of the comparator 3171 is not connected to the ground. In this instance, the output V22 of the comparator 3171 becomes equal to the reference value V21. When the output V22 is "H", therefore, V21=V2. When a reference value V2 obtained when the output V22 is "L" is Vt2, Vt2 is expressed by the following equation:

$$Vt2=R12\times V2/(R11+R12)$$

The values of the resistors R1, R2, and R13 are set so that the voltage V1 becomes lower than the reference value V2 while the CPU 400 is normally operating. Therefore, the output V22 is "H". When the CPU 400 runs away so that an input current Iin increases, however, the input current detection value Is increases, and thus the voltage V1 also increases. When V1>V2, the output V22 becomes "L". An input current limit value I2 obtained at this time is expressed by the following equation:

$$I2=\{(R1\times R2+R2\times R13+R1\times R13)\times V2-R1\times R13\}\times Vs/(R1\times R13)$$

From the foregoing equation, the input current limit value I2 changes according to the input voltage detection value Vs. A relationship of the input voltage detection value Vs to the input current limit value I2 and an input power limit value Pmax is similar to that in the first exemplary embodiment. In the input current limit value calculation circuit 317, the input current limit value I2 is expressed by a primary expression of the input voltage detection value Vs. When the input current detection value Is is higher than the input current limit value I2, the voltage V1 becomes higher than the reference value V2. Therefore, the output V22 of the comparator 3171 becomes "L".

The output V22 of the comparator 3171 is connected to a comparator 3172, and is compared with a reference value V23 (<V2). While the CPU 400 is normally operating, the output V22 is "H", i.e., V22=V2 (>V23). Therefore, an output VE1 of the comparator 3172 becomes "L". When the CPU 400 runs away so that the input current Iin increases, and thus the output V22 becomes "L", however, the output VE1 of the comparator 3172 becomes "H". When the output VE1 becomes "H" so that the supply of a current to the coil L is stopped, the input current detection value Is becomes zero. However, the voltage V1 gradually decreases because energy stored in the capacitor C1 is discharged via the resistor R13. When a period of time corresponding to a time constant has elapsed so that the reference value V21 becomes Vt2 or less, the output VE1 becomes "L", and V21=V2.

Figure 14B:
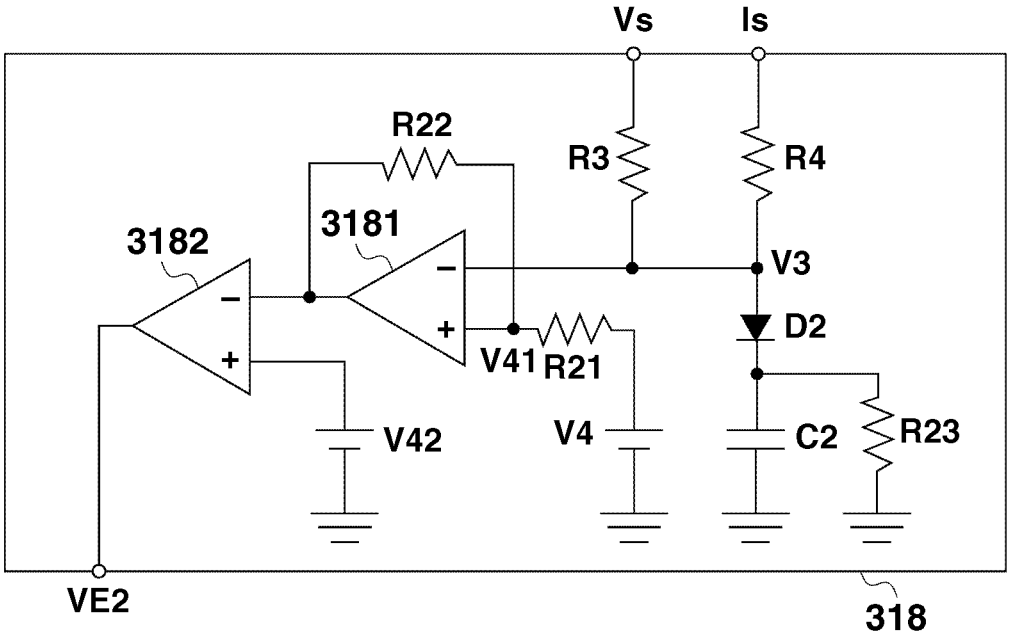

FIG. 14B illustrates the details of an input current limit value calculation circuit 318 in the present exemplary embodiment. While the input current limit value calculation circuit 318 differs from the input current limit value calculation circuit 317 in a constant of each element, it is similar to the input current limit value calculation circuit 317 in an operation and a circuit configuration. As in the input current limit value calculation circuit 317, a voltage V3 illustrated in FIG. 14B, Vt4 (a value of V41 when an output VE2 of a comparator 3182 is "L"), and an input current limit value 14 are expressed by the following equations:

$$V3=(R3\times R23\times Is+R4\times R23\times Vs)/(R3\times R4+R4\times R23+R3\times R23)$$

$$Vt4=R22\times V4/(R21+R22)$$

$$I4=\{(R3\times R4+R4\times R23+R3\times R23)\times V4-R3\times R23\}\times Vs/(R3\times R23)$$

The output VE1 of the comparator 3172 and the output VE2 of the comparator 3182 are input to the AND circuit 320. When both the outputs become "H", an output of the AND circuit 320 becomes "H". The driving unit 312 temporarily forces drive pulses 321 and 322 to stop regardless of driving signals 331 and 332 from the CPU 400. If either one of the outputs VE1 and VE2 becomes "L", the driving of the drive pulses 321 and 322 is resumed.

The operations of the input current limit value calculation circuits 317 and 318 in the present exemplary embodiment will be described below. Operations performed when the CPU 400 is normally operating are similar to those in the first exemplary embodiment.

A case in which the CPU 400 runs away in a 100-V commercial power supply 500 (the maximum value of its input voltage Vin is Vp1) will be described.

When the CPU 400 runs away so that an input current Iin abnormally increases, the input current detection value Is also increases. When the voltage V1 increases according to a time constant curve, to exceed the reference value V2 at time t12 after the lapse of a period of time from time t11, the output VE1 of the comparator 3172 changes from "L" to "H". In the input current limit value calculation circuit 318, the input current detection value Is exceeds I4 so that the output VE2 of the comparator 3182 has already become "H". Therefore, the output VE of the AND circuit 320 also becomes "H". The driving unit 312 forces the drive pulses 321 and 322 to stop regardless of the driving signals 331 and 332 from the CPU 400.

After the drive pulses 321 and 322 stop, the input current detection value Is becomes zero, and the voltage V1 becomes Vt2, which is at a level lower than that of the reference value V2. The voltage V1 decreases according to a time constant curve. When the voltage V1 becomes the reference value Vt2 or less at time t13 after the lapse of a period of time from time t12, the output VE1 changes to "L" again. The voltage V1 also returns to the reference value V2. The voltage V1 exceeds the reference value V2 again at time t14 after the lapse of a period of time from time t13 so that the drive pulses 321 and 322 stop. The output VE1 changes to "H" again after the lapse of a predetermined period of time. The output and the stop of the drive pulses 321 and 322 are repeated.

Figure 15:
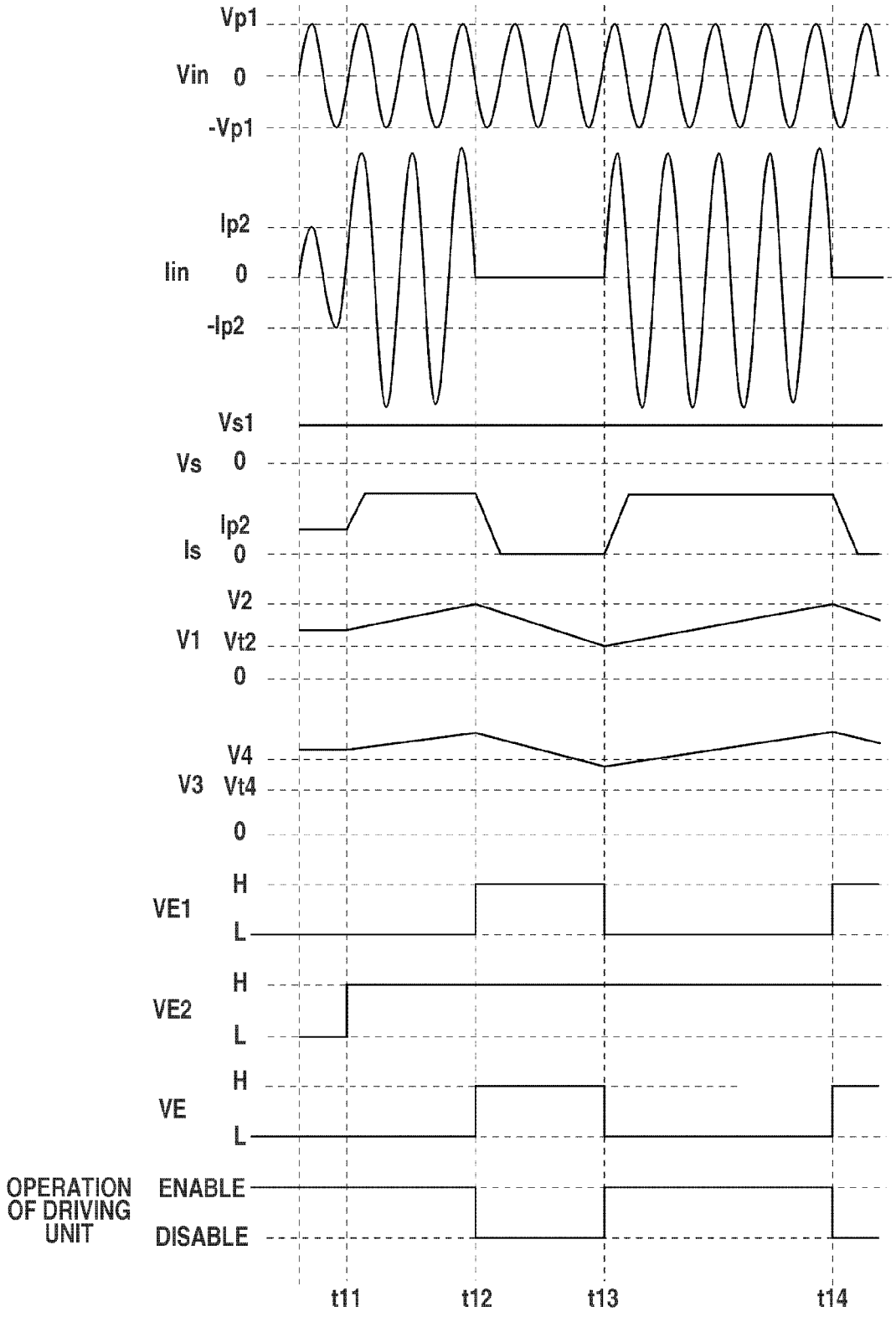
FIG. 15 illustrates a waveform of each unit in a power supply device when a CPU runs away in 100-V input in the second exemplary embodiment.
Figure 16:
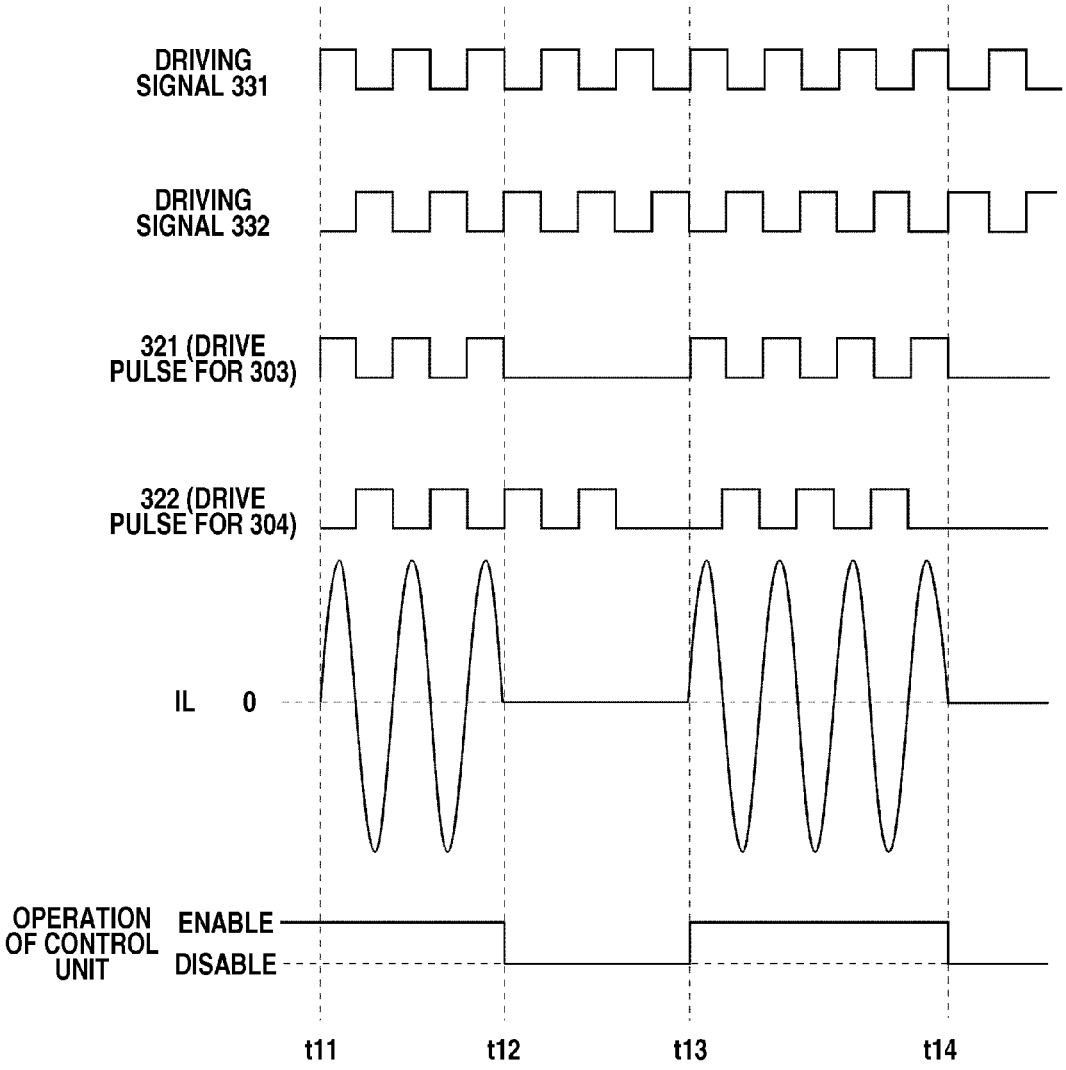
FIG. 16 illustrates a waveform of each unit in a power supply device when a CPU runs away in 100-V input in the second exemplary embodiment.

FIG. 16 illustrates respective waveforms of the driving signals 331 and 332, the drive pulses 321 and 322, and the current IL flowing through the coil L at each timing illustrated in FIG. 15. When the signal VE from the AND circuit 320 changes from "L" to "H" at time t12, the driving unit 312 forces the drive pulses 321 and 322 to stop regardless of the driving signals 331 and 332 from the CPU 400. As a result, the coil current IL also stops. When the output of the drive pulses 321 and 322 is resumed at time t13, energization to the coil L is resumed. The drive pulses 321 and 322 stop again at time t14, and the coil current IL also stops. This operation is repeated.

Operations of a 200-V commercial power supply 500 are similar to those of the 100-V commercial power supply 500 except that the operations of the input current limit value calculation circuit 317 and the input current limit value calculation circuit 318 in the 200-V commercial power supply 500 are reverse to those in the 100-V commercial power supply 500.

As described above, according to the present exemplary embodiment, even when the CPU 400 runs away, to go out of control, the input current can be limited according to the input voltage in a simple configuration. When an abnormal state is continued, an abrupt temperature rise of the fixing unit 7 can be prevented by intermittently operating the driving unit 312.

In a third exemplary embodiment of the present invention, three input current limit value calculation circuits are used. Processing except when the CPU 400 runs away and a circuit configuration except the input current limit value calculation circuits are similar to those in the first exemplary embodiment. Therefore, a circuit configuration of the input current limit value calculation circuits and operations performed when the CPU 400 runs away will be described below.

Figure 17:
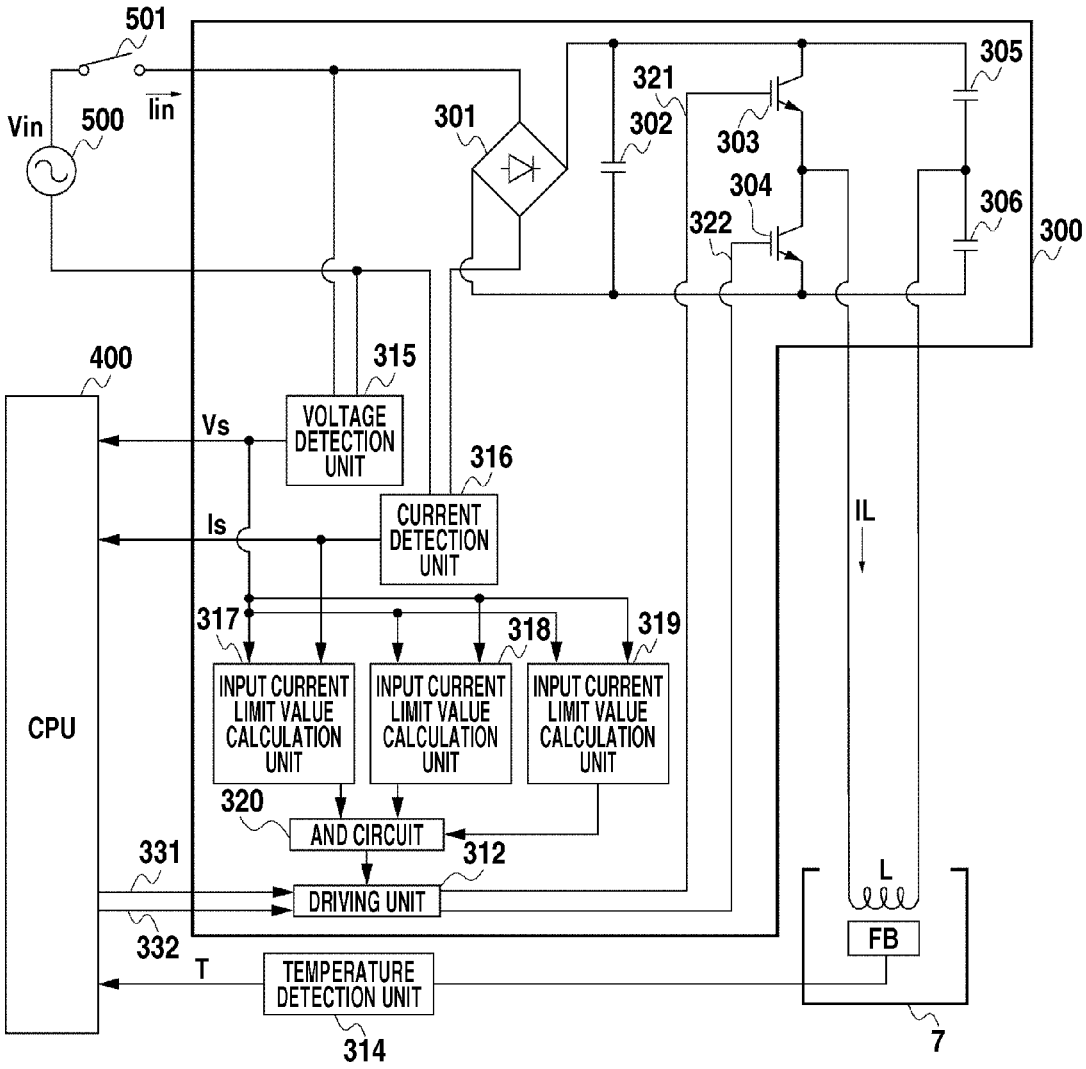
FIG. 17 illustrates a configuration of a power supply device in a third exemplary embodiment of the present invention.

FIG. 17 illustrates a schematic configuration of the fixing unit 7 using an electromagnetic induction heating system and a power supply device in the present exemplary embodiment. Operations other than operations of an input current limit value calculation circuit 317, an input current limit value calculation circuit 318, and an input current limit value calculation circuit 319 are similar to those in the first exemplary embodiment.

In the input current limit value calculation circuits 317, 318, and 319, respective input current limit values are set to different levels with respect to an input voltage. In the input current limit value calculation circuit 317, resistance values and reference values for comparison are set so that an input current is limited when input power, which is higher than maximum power previously set at a voltage of 85 V or more and less than 130 V by a predetermined amount, is supplied. In the input current limit value calculation circuit 318, resistance values and reference values for comparison are set so that an input current is limited when input power, which is higher than maximum power previously set at a voltage of 130 V or more and less than 200 V by a predetermined amount, is supplied. In the input current limit value calculation circuit 319, resistance values and reference values for comparison are set so that an input current is limited when input power, which is higher than maximum power previously set at a voltage of 200 V or more and less than 264 V by a predetermined amount, is supplied.

Figure 18A:
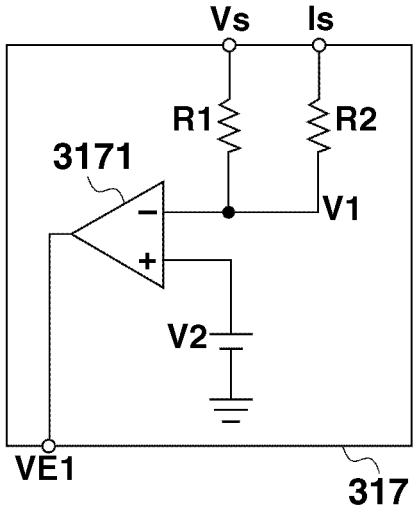
FIGS. 18A to 18C respectively illustrate configurations of input current limit value calculation circuits in the third exemplary embodiment.

FIG. 18A illustrates the details of the input current limit value calculation circuit 317 in the present exemplary embodiment. A detection value Vs from an input voltage detection unit 315 and a detection value Is from an input current detection unit 316 are connected in series with resistors R1 and R2. A voltage V1 at a junction of the resistors R1 and R2 is input to a comparator 3171, and is compared with a reference value V2 (which is not matched with the value in the first exemplary embodiment). An output VE1 of the comparator 3171 is input to the AND circuit 320.

In the configuration illustrated in FIG. 17, the voltage V1 is expressed by the following equation using the input voltage detection value Vs, the input current detection value Is, and the resistors R1 and R2:

$$V1=(R1\times Is+R2\times Vs)/(R1+R2)$$

When the CPU 400 is normally operating, the voltage V1 is lower than the reference value V2. Therefore, the output VE1 is "L". When the input current Iin increases, however, the input current detection value Is increases, and thus the voltage V1 also increases. When V1=V2, the output VE1 becomes "H". A current value (input current limit value) I2 obtained at this time is expressed by the following equation:

$$I2=-(R2/R1)\times Vs+\{(R1+R2)/R1\}\times V2$$

A relationship of the input voltage detection value Vs to the input current limit value I2 and an input power limit value Pmax based on the voltage V1 and the input current limit value I2 is similar to that in the first exemplary embodiment (FIG. 5A).

Figure 18B:
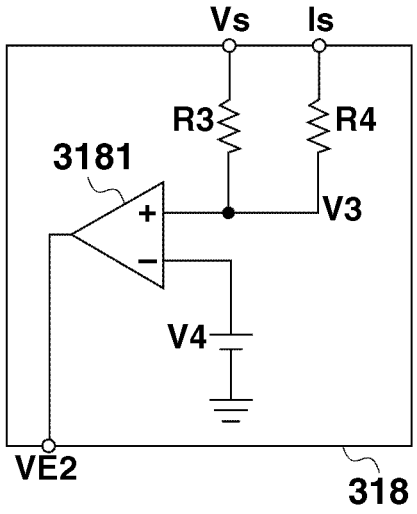

FIG. 18B illustrates the details of the input current limit value calculation circuit 318 in the present exemplary embodiment. While the input current limit value calculation circuit 318 differs from the input current limit value calculation circuit 317 in a constant of each element, it is similar to the input current limit value calculation circuit 317 in an operation and a circuit configuration. As in the input current limit value calculation circuit 317, a voltage V3 illustrated in FIG. 18B and an input current limit value I4 in the input current limit value calculation circuit 318 are expressed by the following equations:

$$V3=(R3\times Is+R4\times Vs)/(R3+R4)$$

$$I4=-(R4/R3)\times Vs+\{(R3+R4)/R3\}\times V4$$

As in the input current limit value calculation circuit 317, an output VE2 of a comparator 3181 is input to the AND circuit 320.

Figure 18C:
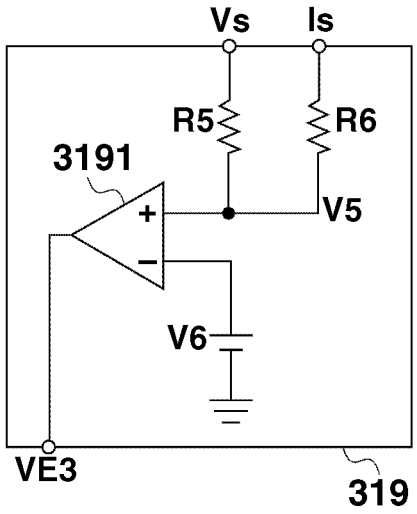

FIG. 18C illustrates the details of the input current limit value calculation circuit 319 in the present exemplary embodiment. While the input current limit value calculation circuit 318 differs from the input current limit value calculation circuit 317 and the input current limit value calculation circuit 318 in a constant of each element, it is similar to the input current limit value calculation circuit 317 and the input current limit value calculation circuit 318 in an operation and a circuit configuration. As in the input current limit value calculation circuit 317 and the input current limit value calculation circuit 318, a voltage V5 illustrated in FIG. 18C and an input current limit value I6 in the input current limit value calculation circuit 319 are expressed by the following equations:

$$V5=(R5\times Is+R6\times Vs)/(R5+R6)$$

$$I6=-(R6/R5)\times Vs+\{(R5+R6)/R5\}\times V6$$

As in the input current limit value calculation circuit 317 and the input current limit value calculation circuit 318, an output VE3 of a comparator 3191 is input to the AND circuit 320.

An output VE of the AND circuit 320 becomes "H" when all of the outputs VE1, VE2, and VE3 become "H". When the output VE is "L", a driving unit 312 forces drive pulses 321 and 322 to stop regardless of driving signals 331 and 332 from the CPU 400.

Figure 19:
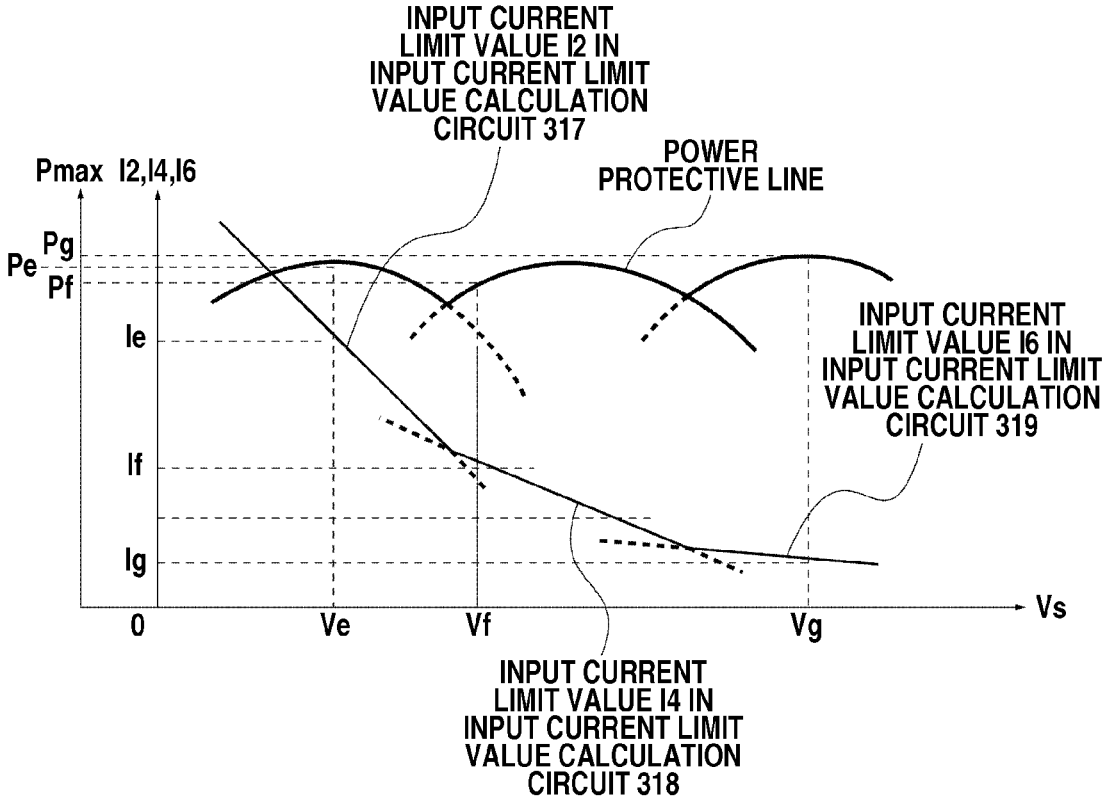
FIG. 19 illustrates characteristics of an input current limit value with respect to an input voltage in the third exemplary embodiment.

FIG. 19 illustrates a relationship of the input voltage detection value Vs to the input current limit value I2, I4, or I6 and the input power limit value Pmax in the present exemplary embodiment. When the input voltage detection value Vs is Ve (85 V≦Ve<130 V), the input current limit value I2 is Ie, and the input power limit value Pmax is Pe. When the input voltage detection value Vs is Vf (130 V≦Vf<200 V), the input current limit value I4 is If (<Ie), and the input power limit value Pmax is Pf (≡Pe). When the input voltage detection value Vs is Vg (200 V≦Vg≦264 V), the input current limit value I6 is Ig (<If), and the input power limit value Pmax is Pg (≡Pf).

The operations of the input current limit value calculation circuits 317, 318, and 319 in the present exemplary embodiment will be described below. The operations performed when the CPU 400 is normally operating are similar to those in the first exemplary embodiment.

Figure 20:
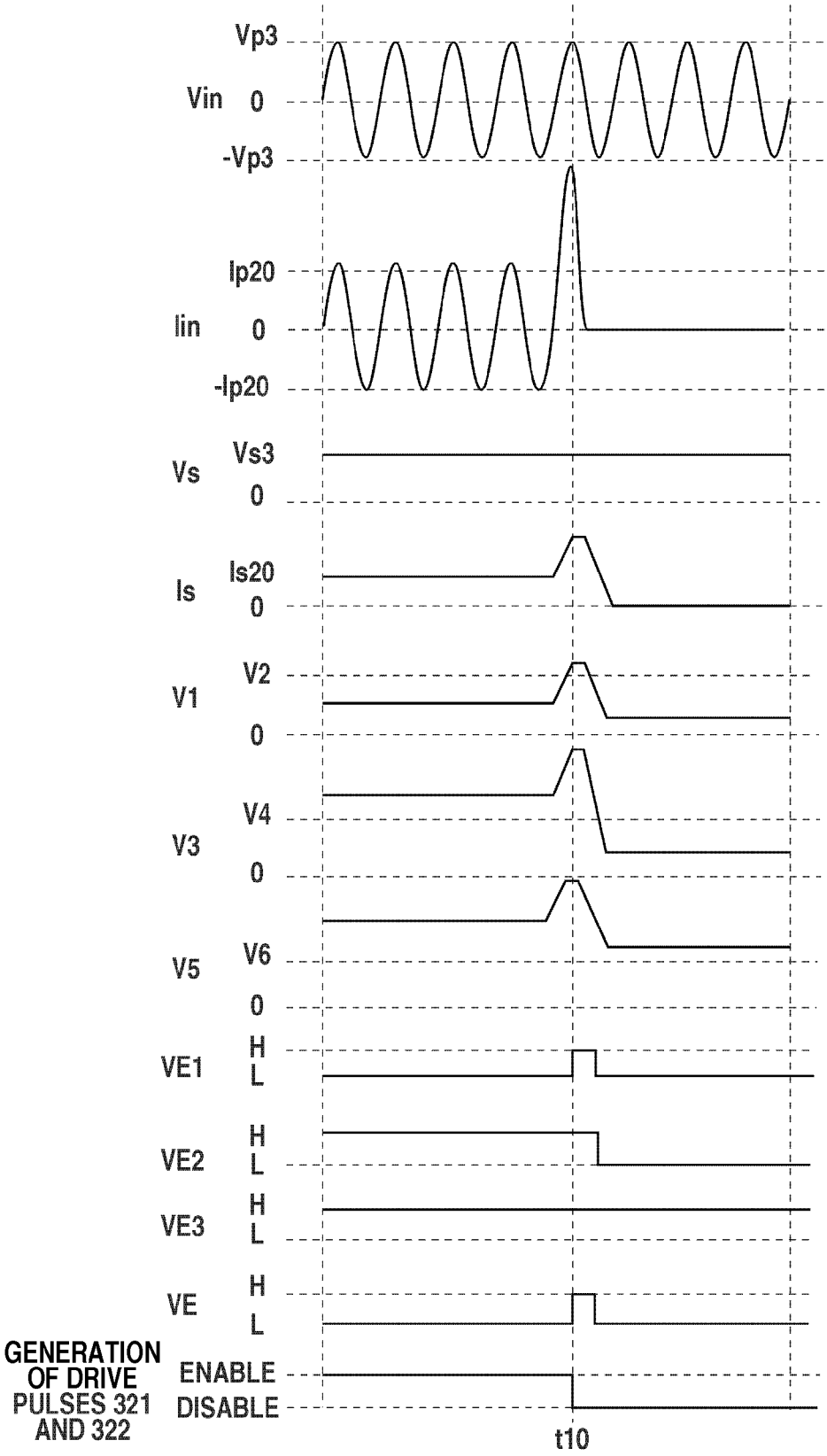
FIG. 20 illustrates a waveform of each unit in a power supply device when a CPU runs away in the third exemplary embodiment.
Figure 21:
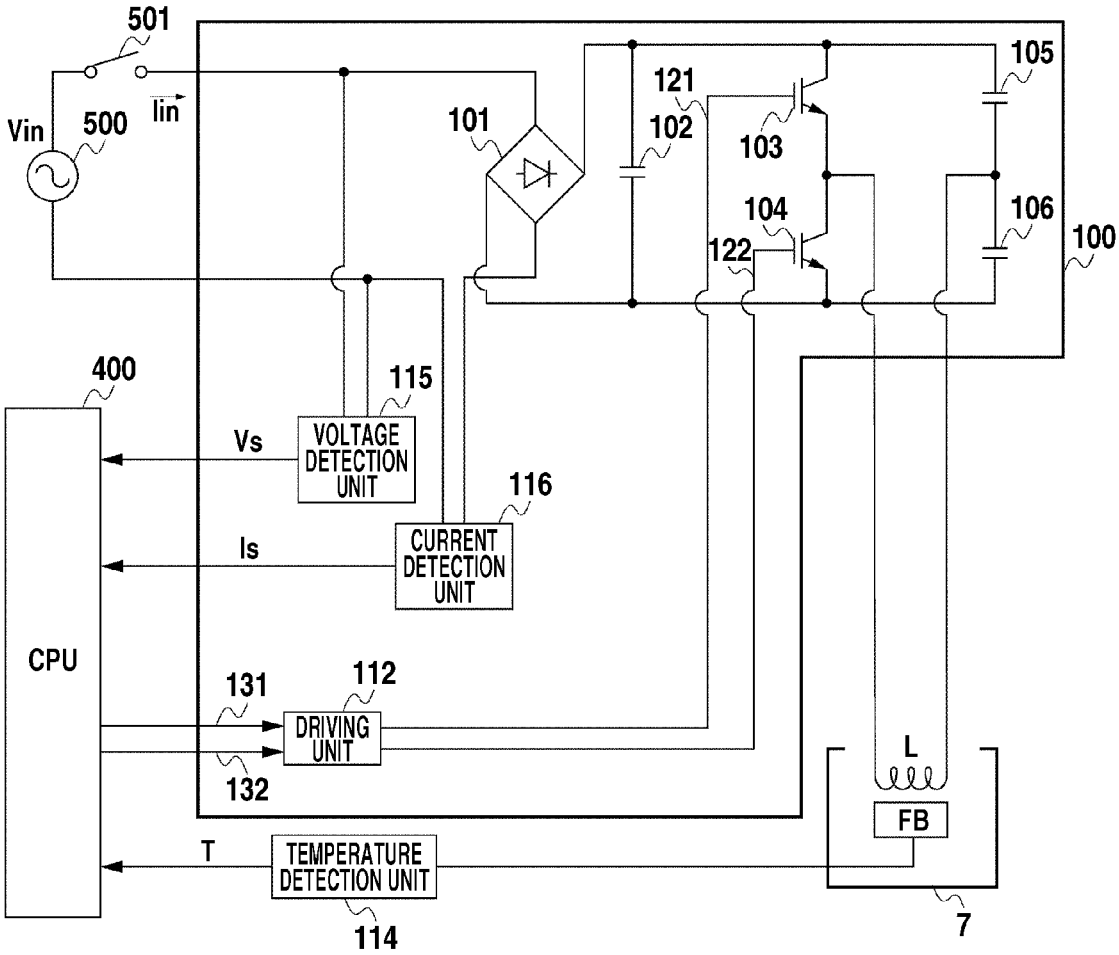
FIG. 21 illustrates the schematic configuration of a conventional power supply device.
Figure 22:
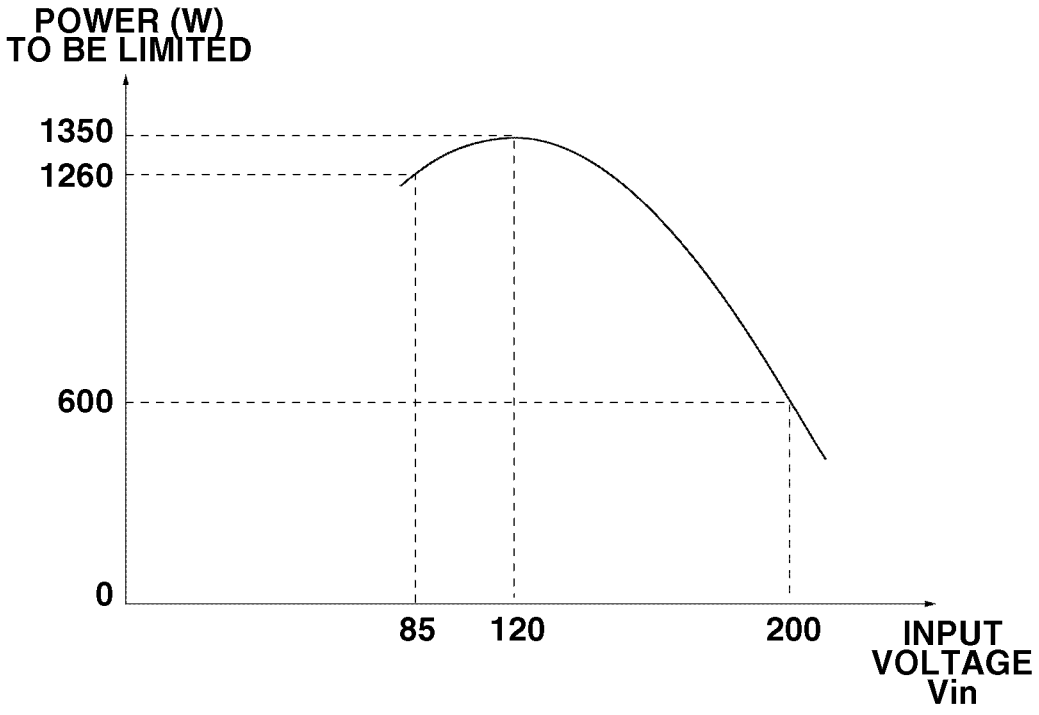
FIG. 22 illustrates characteristics of input power with respect to an input voltage in the conventional power supply device.

FIG. 20 illustrates respective waveforms of units in the power supply device 300 illustrated in FIG. 17 when the input voltage is in a range of 85 V or more and 130 V or less (the maximum voltage is Vp3) and the CPU 400 runs away. When the peak value of the input current Iin greatly exceeds a value Ip20 at time t10 because the CPU 400 runs away, the input current detection value Is also increases, and the voltage V1 also increases correspondingly. When the voltage V1 exceeds the reference value V2, the output VE1 of the comparator 3171 becomes "H". When the input voltage is in a range of 85 V or more and 130 V or less, the respective outputs VE2 and VE3 of the comparators 3181 and 3191 have already become "H". Therefore, the output VE of the AND circuit 320 changes from "L" to "H" at time t10. The driving unit 312 forces the drive pulses 321 and 322 to stop regardless of the driving signals 331 and 332 from the CPU 400.

Even when the input voltage is in a range of 130 V or more and less than 200 V or a range of 200 V or more and 264 V or less, the different input current limit value calculation circuit operates, but the operations thereof are similar.

Even when the CPU 400 runs away, to go out of control, as in each of the above-mentioned exemplary embodiments, the input current can be limited according to the input voltage by using a plurality of input current limit value calculation circuits having a simple configuration.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-145446 filed Jun. 18, 2009, which is hereby incorporated by reference herein in its entirety.

What is claimed is:

1. An induction heating apparatus comprising:

a current supply unit configured to supply a high-frequency current to a coil for inductively heating a conductive heating element based on a direct current obtained by rectifying AC power supplied from an AC power supply;

a driving unit configured to output a drive pulse for supplying the high-frequency current from the current supply unit;

a voltage detection unit configured to detect an input voltage of the AC power supply;

a current detection unit configured to detect an input current of the current supply unit;

a temperature detection unit configured to detect a temperature of the conductive heating element;

a control unit configured to control a frequency of the drive pulse output by the driving unit based on an output of the temperature detection unit, an output of the voltage detection unit, and an output of the current detection unit; and a power limiting unit configured to stop an operation of the driving unit based on the output of the voltage detection unit and the output of the current detection unit, wherein the power limiting unit comprises:

a first limiting circuit configured to output a first signal in a case where the input current exceeds a first limited current that changes according to the input voltage; and a second limiting circuit configured to output a second signal in a case where the input current exceeds a second limited current that changes according to the input voltage, wherein the first limited current is larger than the second limited current in a case where the input voltage is within a first input voltage range, and the first limited current is smaller than the second limited current in a case where the input voltage is within a second input voltage range, and wherein, whether the input voltage is within the first input voltage range or within the second input voltage range, the power limiting unit stops the operation of the driving unit in a case where the first signal is output from the first limiting circuit and the second signal is output from the second circuit, the power limiting unit does not stop the operation of the driving unit in a case where the second signal is not output from the second limiting circuit even if the first signal is output from the first limiting circuit, and the power limiting unit does not stop the operation of the driving unit in a case where the first signal is not output from the first limiting circuit even if the second signal is output from the second limiting circuit.

2. The induction heating apparatus according to claim 1, wherein the power limiting unit is configured to stop the driving unit from outputting the drive pulse.

3. The induction heating apparatus according to claim 1, wherein the induction heating apparatus is provided in a fixing device for fixing a toner image formed on a sheet by an electrophotographic process onto the sheet.

* * * * *